US005273872A

United States Patent [19]

Asami

[11] Patent Number: 5,273,872

[45] Date of Patent: Dec. 28, 1993

[54] SILVER HALIDE PHOTOGRAPHIC MATERIAL AND IMAGE FORMING METHOD USING THE SAME

[75] Inventor: Masahiro Asami, Kanagawa, Japan

[73] Assignee: Fuji Photo Film Co. Ltd., Kanagawa, Japan

[21] Appl. No.: 970,475

[22] Filed: Nov. 3, 1992

[30] Foreign Application Priority Data

Nov. 6, 1991 [JP] Japan ..... 3-317309

[51] Int. Cl.[5] ..... G03C 1/035; G03C 1/09

[52] U.S. Cl. ..... 430/567; 430/600; 430/603; 430/604

[58] Field of Search ..... 430/567, 600, 603, 604

[56] References Cited

U.S. PATENT DOCUMENTS

| | | | |
|---|---|---|---|
| 1,574,944 | 3/1926 | Sheppard | 430/603 |
| 1,602,591 | 10/1926 | Sheppard | 430/603 |
| 3,772,031 | 11/1973 | Berry et al. | 430/567 |
| 5,057,402 | 10/1991 | Shiba et al. | 430/567 |

FOREIGN PATENT DOCUMENTS

| | | | |
|---|---|---|---|
| 800958 | 12/1968 | Canada . | |
| 423765 | 4/1991 | Japan | 430/604 |
| 3-188437 | 8/1991 | Japan | 430/604 |
| 1295462 | 11/1972 | United Kingdom . | |
| 1396696 | 6/1975 | United Kingdom . | |
| 2109576 | 6/1983 | United Kingdom . | |

*Primary Examiner*—Janet C. Baxter

*Attorney, Agent, or Firm*—Sughrue, Mion, Zinn, Macpeak & Seas

[57] ABSTRACT

A silver halide photographic material having at least one light-sensitive emulsion layer on a support, wherein at least one light-sensitive emulsion layer has an emulsion containing silver halide grains of silver chlorobromide, silver chloroiodide, silver chloroiodobromide or silver chloride having a silver chloride content of 90 mol % or more, and incorporated with the silver halide grains are an iron compound of from $10^{-7}$ to $10^{-3}$ mol per mol of silver halide, and a tellurium compound of from $10^{-7}$ to $10^{-4}$ mol per mol of silver halide, before completion of physical ripening of the grains. The photographic material of the present invention is exposed for a short time period of $10^{-3}$ second or less and then color-developed to form a photographic image. The material has high sensitivity and high contrast and has excellent rapid processability. The material is free from fluctuations in the sensitivity and gradation under variations in the ambient temperature during exposure, and also under variation of the exposure intensity, and it is especially suitable to high-intensity exposure.

10 Claims, No Drawings

SILVER HALIDE PHOTOGRAPHIC MATERIAL AND IMAGE FORMING METHOD USING THE SAME

FIELD OF THE INVENTION

The present invention relates to a silver halide photographic material and an image forming method using the same. More precisely, it relates to a silver halide photographic material having excellent rapid processability, which involves little generation of fog, gives a photographic image of high sensitivity and high contrast, and which has very little fluctuation in photographic properties due to variation of the ambient temperature during exposure thereof, and also to a method of forming a photographic image using the material. The photographic material of the present invention is especially suitable to an image forming method where exposure of the material is effected through short time exposure, for example, by laser scanning exposure.

BACKGROUND OF THE INVENTION

A photographic system where a photographic element comprising silver halide grains is used for recording an image followed by development to reproduce and store a photographic image has been developed significantly in recent years and is now applied in various technical fields. Above all, the market for color photographs, which are utilized by many people for the purpose of recording and seeing images, is expanding year by year. In particular, in color print production, the demand for the delivery of finished prints in a short amount of time is increasing rapidly. As a result, the need for the production of color prints with high efficiency and high producibility is rising steadily.

As is well known, the process of finishing color prints comprises exposure of a printing photographic material to be effected through an image-recorded negative film and color development of the exposed photographic material. Use of a high-sensitivity photographic material results in shortening the exposure time. Therefore, in order to shorten the color development time, it is essential to use a photographic material which may be rapidly developed.

A known means for attaining the above-mentioned qualities is a method of processing a color photographic paper containing a so-called high silver chloride emulsion having an elevated silver chloride content, in place of a high silver bromide emulsion having a high silver bromide content, which has heretofore been widely incorporated in conventional color printing photographic materials (hereinafter referred to as a "color photographic paper"). For instance, International Laid-Open Patent Application WO87-04534 has disclosed a method for rapidly processing a color photographic paper which contains a high silver chloride emulsion using a color developer which does not substantially contain a sulfite ion and a benzyl alcohol.

For the purpose of obtaining a photographic system which may be processed rapidly, attempts to put silver halide emulsions having a high silver chloride content into practical use have previously been made actively. In general, it is known that a high silver chloride emulsion often involves the generation of much fog and cannot have a high sensitivity. It is also known that such an emulsion often involves the so-called reciprocity law failure of fluctuation of the sensitivity and gradation thereof, which is caused by variation in the intensity of light which is applied thereto for exposure. In addition, it is also known that the sensitivity of such an emulsion often fluctuates due to variations in the ambient temperature during exposure. These drawbacks have been significant impediments to the practical use of high silver chloride emulsions.

Various technical means for overcoming the above-mentioned drawbacks of high silver chloride emulsions have previously been reported.

For instance, JP-A-58-95736, JP-A-58-108533, JP-A-60-222844 and JP-A-60-222845 (the term "JP-A" as used herein means an "unexamined published Japanese patent application") disclose various high silver chloride emulsions of various grain structures, which contain silver halide grains each having a layer having a high silver bromide content so as to have a high sensitivity while retarding fogging of the emulsion. By the present inventors' investigation of the disclosed technology, however, it has been found that such high silver chloride emulsions do have a high sensitivity, but they are easily desensitized when pressure is applied to the emulsion grains. Such poor pressure resistance of the grains has been found to be a fatal defect for practical use of the grains.

JP-A-51-139323 and JP-A-59-171947 and British Patent 2,109,576A describe high-sensitivity silver halide emulsions containing a compound of a group VIII metal, and such emulsions are free from reciprocity law failure. JP-A-49-33781, JP-A-50 23618, JP-A-52-18310, JP-A-58-15952, JP-A-59-214028, JP-A-61-67845, German Patents 2,226,877, 2,708,466 and U.S. Pat. No. 3,803,584 describe silver halide emulsions, which may yield hard images and which are free from reciprocity law failure, that are obtained by incorporating a rhodium compound or iridium compound into the emulsion. However, while emulsions containing a rhodium compound do yield hard images, they are also noticeably desensitized and thus they are unfavorable for practical use. On the other hand, emulsions containing an iridium compound notably involve the so-called latent image sensitization, which involves an increase in the developed density when a period of time passes between the exposure of the photographic material having the emulsion and the processing thereof. Therefore, such emulsions are also unfavorable for practical use.

U.S. Pat. No. 4,269,927 describes surface latent image-type high silver chloride emulsion grains having a silver chloride content of 80 mol % or more where the sensitivity is elevated by the incorporation of cadmium, lead, copper, zinc, or a mixture thereof, into the inside of the emulsion grains. While using such emulsion grains may achieve some results towards increasing the sensitivity and removing the reciprocity law failure, the sensitivity fluctuations of these emulsions due to variations in the ambient temperature during exposure could not be fully overcome.

JP-B-48-35373 (the term "JP-B" as used herein means an "examined Japanese patent publication") describes a hard black-and-white printing paper which is inexpensively produced by incorporating a water-soluble iron compound into a silver chloride emulsion obtained by a normal mixing method. In accordance with the disclosed means, the high intensity sensitivity of the silver chloride emulsion can be elevated, but the sensitivity fluctuations of the emulsion due to variations in the ambient temperature during exposure could not be fully overcome and, in particular, the temperature dependence of the emulsion's sensitivity during high intensity exposure could not be fully overcome.

JP-A-1-183647 describes that addition of a silver bromide local layer to the inside or the surface of high silver chloride emulsion grains which contain iron ions results in elevation of the emulsion grains' sensitivity, and that sensitivity fluctuations due to variations in the ambient temperature during exposure may thereby be reduced. However, the disclosed technology is not sufficient to overcome the temperature dependence of the emulsion grain sensitivity during high intensity exposure.

SUMMARY OF THE INVENTION

As is obvious from the above-mentioned explanation, the first object of the present invention is to provide a silver halide emulsion having excellent rapid processability while also having high sensitivity and high contrast, and also to provide for a silver halide photographic material which contains this emulsion.

The second object of the present invention is to provide a silver halide emulsion which involves little fluctuation of the sensitivity and gradation due to variation of the exposure intensity, and especially involves little fluctuation of the sensitivity due to variations in the ambient temperature during high intensity exposure, and also to provide a silver halide photographic material which contains this emulsion.

The third object of the present invention is to provide an image forming method using the above-mentioned silver halide photographic materials.

The objects of the present invention have been achieved by a silver halide photographic material having at least one light-sensitive emulsion layer on a support, in which at least one light-sensitive emulsion layer has an emulsion containing silver halide grains of silver chlorobromide, silver chloroiodide, silver chloroiodobromide or silver chloride having a silver chloride content of 90 mol % or more, and the silver halide grains contain an iron compound in an amount of from $10^{-7}$ to $10^{-3}$ mol, per mol of silver halide, and a tellurium compound in an amount of from $10^{-7}$ to $10^{-4}$ mol, per mol of silver halide, before completion of the physical ripening of the grains. The objects of the present invention have also been achieved by a method of forming a photographic image which exposes the silver halide photographic material for the short period of time of $10^{-3}$ second or less, followed by developing the exposed material.

As one preferred embodiment of the silver halide photographic material of the present invention, the iron compound to be in the silver halide grains is a di-valent or tri-valent iron complex compound as coordinated with 5 or 6 cyan ligands.

As another preferred embodiment of the silver halide photographic material of the present invention, the iron compound and the tellurium compound in the silver halide grains are locally present in the surface layer of each grain corresponding to up to 50% of the grain volume from the surface of the grain.

DETAILED DESCRIPTION OF THE INVENTION

In forming grains of a silver halide emulsion, a technical means of uniformly dispersing and incorporating from 2 to 10 ppm of sulfur group element ions substantially in the grains has been disclosed in U.S. Pat. No. 3,772,031. This patent reports that a high-sensitivity emulsion can be obtained by the technology, and that there is little fogging of the emulsion even when the emulsion is stored at a high temperature under dry conditions. However, as a result of the present inventors' investigation of the related technology of applying the means of incorporating sulfur group element ions into silver halide grains to a high silver chloride emulsion, various problems have been found. Precisely, when the silver chloride content in the emulsion grains, to which the sulfur group element ions are incorporated, is elevated, fogging of the emulsion noticeably increases. More precisely, the presence of sulfur group element ions during formation of high silver chloride grains causes an increase of fog in the emulsion of the grains prior to the elevation of the sensitivity of the same and, as a result, preparation of an emulsion for practical use is therefore difficult using this technology.

In this situation, the present inventors earnestly studied and investigated the related technology and, as a result, found that joint incorporation of both an iron compound and a tellurium compound into high silver chloride emulsion grains may satisfactorily overcome the above-mentioned drawbacks. On the basis of this finding, the present invention was achieved.

It has also been found that the silver halide photographic material of the present invention is noticeably improved to have little sensitivity fluctuation due to variations in the ambient temperature during exposure. This is a novel effect achieved by the present invention.

The silver halide emulsion of the present invention contains silver halide grains of silver chlorobromide, silver chloroiodide, silver chloroiodobromide or silver chloride having a silver chloride content of 90 mol % or more, preferably 95 mol % or more, more preferably 98 mol % or more. Other than containing an iron compound and a tellurium compound, the grains may preferably comprise a pure silver chloride.

Where the silver halide grains of the present invention contain silver bromide, the silver bromide phase may preferably be in the form of a silver bromide local phase having a silver bromide content of less than 70 mol %, which may be in the inside or on the surface of each grain. In this case, the silver bromide local phase may be in the form of a core in the inside of each grain or in the form of a layered shell around each grain. The silver bromide local phase may also be in each grain at random as a non-layered form. For example, in the latter case, the presence of a silver bromide local phase may be found on the edges or corners of the surface of each grain as epitaxial junctions.

Where the silver halide emulsion contains silver iodide, the silver iodide content therein is preferably 2 mol % or less to per mol of silver halide.

To incorporate an iron compound into the silver halide emulsion grains for carrying out the present invention, it is easy to add a water-soluble iron compound in the step of forming the emulsion grains. Such an iron compound is a compound containing a divalent or trivalent iron ion and is preferably soluble in water within the scope of the present invention. Especially preferred as such an iron compound are iron complexes which may easily be incorporated into the inside of silver halide grains. Specific examples of such compounds are: ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ammonium ferrous nitrate, basic ferric acetate, ferric alubminate, ammonium ferric acetate, ferric bromide, ferric chloride, ferric chromate, ferric citrate, ferric fluoride, ferric formate, ferric glycerophosphate, ferric hydroxide, acidic ferric phosphate, ferric nitrate, ferric phosphate, ferric pyrophosphate, sodium ferric pyrophosphate, ferric thiocyanate, ferric sulfate, ammonium ferric sulfate, guanidinium ferric sulfate, ammonium ferric citrate, potassium hexacyanoferrate(II), potassium pentacyanoamine ferrate (II), sodium ethylenedinitrilotetraacetatoferrate(III), potassium hexacyanoferrate(III), tris(bipyridyl) chloride/Fe(III), and potassium pentacyanonitrosyl ferrate(III).

Of these iron compounds, especially preferred are divalent or trivalent iron complex compounds each as coordinated with 5 or 6 cyan ligands.

The above-mentioned iron compound may be incorporated into the silver halide grains of the present invention by adding the iron compound to a solution of a dispersing medium (gelatin or protective colloidal polymer), or to an aqueous halide solution, or to an aqueous silver salt solution, or to other aqueous solutions during the formation of the silver halide grains.

In the present invention, the amount of the iron compound to be added may be from $10^{-7}$ to $10^{-3}$ mol per mol of silver halide, more preferably from $1\times10^{-6}$ to $5\times10^{-4}$ mol per mol of silver halide.

In the present invention, the iron compound may be in the inside of each silver halide grains in any desired distribution degree. For instance, the iron compound may be added to the reaction system which forms the silver halide grains such that it may be uniformly distributed in the inside of each grain; or alternatively, it may be added thereto in such a way that the compound may be localized in a specific position (either inside or on the surface) of each grain.

As one preferred embodiment of the present invention, 80% or more of the iron compound added is localized in the surface layer of each silver halide grain corresponding to up to 50%, preferably 40% or less, more preferably 20% or less, of the grain volume from the surface of the grain. The volume of the surface layer is preferably as small (thin) as possible, in order to inhibit elevation of the internal sensitivity and to advantageously obtain a higher sensitivity. In order to concentratedly incorporate the iron compound into the surface layer of each silver halide grain, a silver halide grain core without the surface layer is first formed, and then the iron compound is added to the resulting core, along with a water-soluble silver salt solution and an aqueous halide solution, in order to form the surface layer on the core.

In the present invention, the amount of the iron compound to be in the silver halide grains is preferably within the above-mentioned range. If it is smaller than the range, the advantageous effects of the present invention cannot be obtained. On the other hand, if the amount of the iron compound is larger than the stated range, it often results in the drawback of desensitization under pressure.

The silver halide grains of the present invention contain a tellurium compound along with the iron compound. In order to incorporate these compounds into the silver halide grains of the present invention, it is easy to add them to the step of forming the grains. Specifically, the tellurium compounds may be added to a solution of a dispersing medium (gelatin or protective colloidal polymer), or to an aqueous halide solution, or to an aqueous silver salt solution, or to any other aqueous solutions during the formation of the silver halide grains whereby the grains formed may contain the added compounds.

As the tellurium compound to be incorporated into the silver halide grains of the present invention, preferred are compounds as described in U.S. Pat. Nos. 1,623,499, 3,320,069, 3,772,031, British Patents 235,211, 1,121,496, 1,295,462, 1,296,696, Canadian Patent 800,958, *J. Chem. Soc. Chem. Commun.*, 635 (1980), ibid., 1102 (1979), ibid., 645 (1979), and *J. Chem. Soc. Perkin Trans.*, 1, 2191 (1980).

As specific examples of the tellurium sensitizing agent for use in the present invention, there are mentioned telluroureas (e.g., allyltellurourea, N,N-dimethyltellurourea, tetramethyltellurourea, N-carboxyethyl-N',N'-dimethyltellurourea, N,N'-dimethylethylenetellurourea, N,N'-diphenylethylenetellurourea), isotellurocyanates (e.g., allylisotellurocyanate), telluroketones (e.g., telluroacetone, telluroacetophenone), telluroamides (e.g., telluroacetamide, N,N-dimethyltellurobenzamide), tellurohydrazides (e.g., N,N',N'-trimethyltellurobenzhydrazide), telluroesters (e.g., t-butyl-t-hexyltelluroester), phosphine tellurides (e.g., tributylphosphine telluride, tricyclohexylphosphine telluride, triisopropylphosphine telluride, butyl-diisopropylphosphine telluride, dibutylphenylphosphine telluride), and other tellurium compounds (e.g., negative-charged telluride ion-containing gelatin as described in British Patent 1,295,462), potassium telluride, potassium tellurocyanate, telluropentathionate sodium salt, allyltellurocyanate.

Of these tellurium compounds, preferred are those of the general formulae (II) and (III).

Formula (II) is as follows:

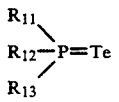

(II)

where, $R_{11}$, $R_{12}$ and $R_{13}$ independently represent an aliphatic group, an aromatic group, a heterocyclic group, $OR_{14}$, $NR_{15}(R_{16})$, $SR_{17}$, $OSiR_{18}(R_{19})(R_{20})$, X, or a hydrogen atom;

$R_{14}$ and $R_{17}$ independently represent an aliphatic group, an aromatic group, a heterocyclic group, a hydrogen atom or a cation;

$R_{15}$ and $R_{16}$ independently represent an aliphatic group, an aromatic group, a heterocyclic group or a hydrogen atom;

$R_{18}$, $R_{19}$ and $R_{20}$ independently represent an aliphatic group; and X represents a halogen atom.

Compounds of formula (II) are explained in more detail below.

In formula (II), the aliphatic group of $R_{11}$, $R_{12}$, $R_{13}$, $R_{14}$, $R_{15}$, $R_{16}$, $R_{17}$, $R_{18}$, $R_{19}$ or $R_{20}$ is preferably one having from 1 to 30 carbon atoms, especially a linear, branched or cyclic alkyl, alkenyl, alkynyl or aralkyl group having from 1 to 20 carbon atoms. As the alkyl, alkenyl, alkynyl and aralkyl groups, there are mentioned, for example, methyl, ethyl, n-propyl, isopropyl, t-butyl, n-octyl, n-decyl, n-hexadecyl, cyclopentyl, cyclohexyl, allyl, butenyl, 3-pentenyl, propargyl, 3-pentynyl, benzyl and phenethyl groups.

In formula (II), the aromatic group of $R_{11}$, $R_{12}$, $R_{13}$, $R_{14}$, $R_{15}$, $R_{16}$ or $R_{17}$ is preferably one having from 6 to 30 carbon atoms, especially preferably a monocyclic or condensed cyclic aryl group having from 6 to 20 carbon atoms. This includes, for example, phenyl and naphthyl groups.

In formula (II), the heterocyclic group of $R_{11}$, $R_{12}$, $R_{13}$, $R_{14}$, $R_{15}$, $R_{16}$ or $R_{17}$ is a 3-membered to 10-membered saturated or unsaturated heterocyclic group containing at least one hetero atom of nitrogen, oxygen and sulfur atoms. This may be a monocyclic one or may form a condensed ring with other aromatic ring(s) and/or heterocyclic ring(s). The heterocyclic group is preferably a 5- or 6-membered aromatic heterocyclic group, including, for example, pyridyl, furyl, thienyl, thiazolyl, imidazolyl and benzimidazolyl groups.

In formula (II), the cation of $R_{14}$ or $R_{17}$ is, for example, an alkali metal cation or an ammonium cation.

In formula (II), the halogen atom of X is, for example, fluorine atom, chlorine atom, bromine atom or iodine atom.

The aliphatic group, aromatic group and heterocyclic group may optionally be substituted.

As substituents for the groups, there are typically mentioned an alkyl group, an aralkyl group, an alkenyl group, an alkynyl group, an aryl group, an alkoxy group, an aryloxy group, an amino group, an acylamino group, an ureido group, an urethane group, a sulfonylamino group, a sulfamoyl group, a carbamoyl group, a sulfonyl group, a sulfinyl group, an alkyloxycarbonyl group, an aryloxycarbonyl group, an acyl group, an acyloxy group, a phosphoric acid amido group, a diacylamino group, an imido group, an alkylthio group, an arylthio group, a halogen atom, a cyano group, a sulfo group, a carboxyl group, a hydroxyl group, a phosphono group, a nitro group, and a heterocyclic group. These groups may further be substituted. If the group has two or more substituents, they may be same as or different from one another.

$R_{11}$, $R_{12}$ and $R_{13}$ may be bonded to each other to form a ring along with the phosphorus atom in the formula; and $R_{15}$ and $R_{16}$ may be bonded to each other to form a nitrogen-containing hetero ring which has the same meaning as mentioned above.

In formula (II), $R_{11}$, $R_{12}$ and $R_{13}$ each are preferably an aliphatic group or an aromatic group, more preferably an alkyl group or an aromatic group.

Formula (III) is as follows:

$$R_{21}-\overset{\overset{\displaystyle Te}{\|}}{C}-R_{22} \qquad \text{(III)}$$

where $R_{21}$ represents an aliphatic group, an aromatic group, a heterocyclic group, or $-NR_{23}(R_{24})$;

$R_{22}$ represents $-NR_{25}(R_{26})$, $-N(R_{27})N(R_{28})R_{29}$, or $-OR_{30}$;

$R_{23}$, $R_{24}$, $R_{25}$, $R_{26}$, $R_{27}$, $R_{28}$, $R_{29}$ and $R_{30}$ each represent a hydrogen atom, an aliphatic group, an aromatic group, a heterocyclic group or an acyl group; and $R_{21}$ and $R_{25}$; $R_{21}$ and $R_{27}$; $R_{21}$ and $R_{28}$; $R_{21}$ and $R_{30}$; $R_{23}$ and $R_{25}$; $R_{23}$ and $R_{27}$; $R_{23}$ and $R_{28}$; and $R_{23}$ and $R_{30}$ each may be bonded to each other to form a ring.

Compounds of formula (III) are explained in more detail below.

In formula (III), the aliphatic group of $R_{21}$, $R_{23}$, $R_{24}$, $R_{25}$, $R_{26}$, $R_{27}$, $R_{28}$, $R_{29}$ or $R_{30}$ is one having from 1 to 30 carbon atoms, especially a linear, branched or cyclic alkyl, alkenyl, alkynyl or aralkyl group having from 1 to 20 carbon atoms. As the alkyl, alkenyl, alkynyl and aralkyl groups, there are mentioned, for example, methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, 3-pentynyl, benzyl and phenethyl groups.

In formula (III), the aromatic group of $R_{21}$, $R_{23}$, $R_{24}$, $R_{25}$, $R_{26}$, $R_{27}$, $R_{28}$, $R_{29}$ or $R_{30}$ is preferably one having from 6 to 30 carbon atoms, especially preferably a monocyclic or condensed cyclic aryl group having from 6 to 20 carbon atoms. This includes, for example, phenyl and naphthyl groups.

In formula (III), the heterocyclic group of $R_{21}$, $R_{23}$, $R_{24}$, $R_{25}$, $R_{26}$, $R_{27}$, $R_{28}$, $R_{29}$ or $R_{30}$ is a 3-membered to 10-memberfed saturated or unsaturated heterocyclic group containing at least one hetero atom of nitrogen, oxygen and sulfur atoms. This may be a monocyclic one or may form a condensed ring with other aromatic ring(s) and/or heterocyclic ring(s). The heterocyclic group is preferably a 5- or 6-membered aromatic heterocyclic group, including, for example, pyridyl, furyl, thienyl, thiazolyl, imidazolyl and benzimidazolyl groups.

In formula (III), the acyl group of $R_{23}$, $R_{24}$, $R_{25}$, $R_{26}$, $R_{27}$, $R_{28}$, $R_{29}$ or $R_{30}$ is preferably one having from 1 to 30 carbon atoms, especially preferably a linear or branched acyl group having from 1 to 20 carbon atoms. It includes, for example, acetyl, benzoyl, formyl, pivaloyl and decanoyl groups.

Where $R_{21}$ and $R_{25}$; $R_{21}$ and $R_{27}$; $R_{21}$ and $R_{28}$; $R_{21}$ and $R_{30}$; $R_{23}$ and $R_{25}$; $R_{23}$ and $R_{27}$; $R_{23}$ and $R_{28}$; and $R_{23}$ and $R_{30}$ each form a ring, the atomic group necessary for forming the ring includes, for example, an alkylene group, an arylene group, an aralkylene group and an alkenylene group.

The aliphatic group, aromatic group and heterocyclic group may optionally be substituted by one or more substituents, such as those mentioned for formula (II).

More preferably in formula (III), $R_{21}$ is an aliphatic group, an aromatic group, or $-NR_{23}(R_{24})$; $R_{22}$ is $-NR_{25}(R_{26})$; and $R_{23}$, $R_{24}$, $R_{25}$ and $R_{26}$ each are an aliphatic group or an aromatic group.

Especially preferably in formula (III), $R_{21}$ is an aromatic group or $-NR_{23}(R_{24})$; $R_{22}$ is $-NR_{25}(R_{26})$; and $R_{23}$, $R_{24}$, $R_{25}$ and $R_{26}$ each are an alkyl group or an aromatic group. Also preferably, $R_{21}$ and $R_{25}$; and $R_{23}$ and $R_{25}$ each may form a ring via an alkylene group, an arylene group, an aralkylene group or an alkenylene group.

Specific examples of compounds of formulae (II) and (III) for use in the present invention are mentioned below, but, are not limited to these examples.

$(nC_4H_9)_3P{=}Te$ II-1.

$(tC_4H_9)_3P{=}Te$ II-2.

II-3.

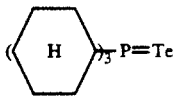

$((i)C_3H_7)_3P{=}Te$ II-4.

-continued
II-5.
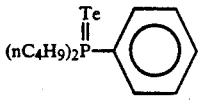
II-6.
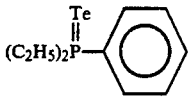
II-7. $((i)C_4H_9)_3P{=}Te$
II-8. $((i)C_4H_9)_2P(Te)C_4H_9(n)$
II-9. $(i)C_3H_7P(Te)(C_4H_9(n))_2$
II-10. $((i)C_3H_7)_2P(Te)(C_4H_9(n))$
II-11. $(i)C_3H_7P(Te)(C_4H_9(i))_2$
II-12. $((i)C_3H_7)_2P(Te)C_4H_9(i)_2$
II-13. $((i)C_3H_7)_2P(Te)C_8H_{17}(n)_2$
II-14. $C_2H_5P(Te)(OC_2H_5)_2$
II-15. $(n\text{-}C_4H_9O)_3P{=}Te$
II-16. $C_2H_5P(Te)\text{—}(N(CH_3)_2)_2$
II-17.
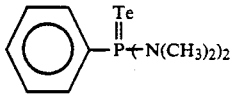
II-18. $((CH_3)_2N)_3P{=}Te$
II-19. $((CH_3)_2SiO)_2P(Te)H$
II-20.
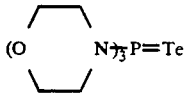
II-21. $(C_2H_5)_2P(Te)N(C_2H_5)_2$
II-22. $H_2P(Te)NH_2$
III-1.
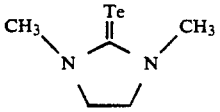
-continued
III-2.
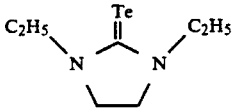
III-3.
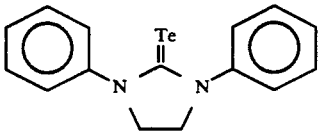
III-4.
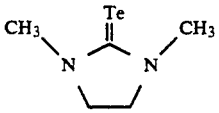
III-5.
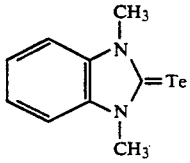
III-6.
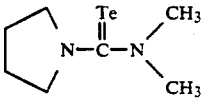
III-7.
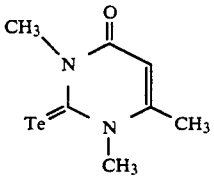
III-8.
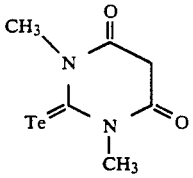
III-9.
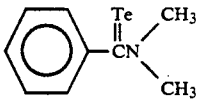
III-10.
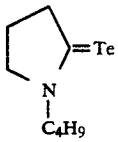
III-11.
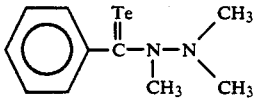

-continued

III-12.

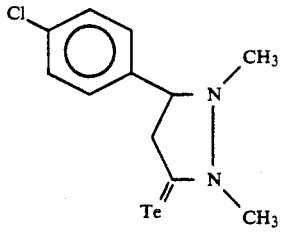

III-13.

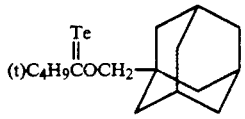

III-14.

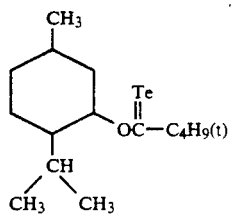

III-15.

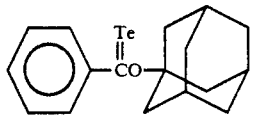

III-16.

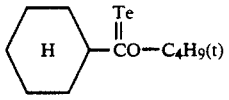

Compounds of formulae (II) and (III) for use in the present invention may be produced in accordance with known methods. For instance, they may be produced by the methods described in *J. Chem. Soc.* (A), 1969, 2927; *J. Organomet. Chem.*, 4, 320 (1965); ibid., 1, 200 (1963); ibid., 113, C35 (1976); *Phosphorus Sulfur*, 15, 155 (1983); *Chem. Ber.*, 109, 2996 (1976); *J. Chem. Soc. Chem. Commun.*, 635 (1980); ibid., 1102 (1979); ibid., 645 (1979); ibid., 820 (1987); *J. Chem. Soc. Perkin, Trans.*, 1, 2191 (1980); and *The Chemistry of Organo Selenium and Tellurium Compounds*, Vol. 2, 216 to 267 (1987).

In the present invention, the amount of the tellurium compound to be in the silver halide grains is preferably with the range of from $10^{-7}$ to $10^{-4}$ mol per mol of silver halide, more preferably from $5\times10^{-6}$ to $5\times10^{-5}$ mol per mol of silver halide. If it is smaller than the range, the advantageous effects of the present invention cannot be obtained. On the other hand, if the amount is larger than the stated range, it would often result in the disadvantage of causing a great deal of fog.

In the present invention, the tellurium compound may be in the inside of each silver halide grains in any desired distribution degree. For instance, the tellurium compound may be added to the reaction system which forms the silver halide grains such that it may be uniformly distributed in the inside of each grain; or alternatively, it may be added thereto in such a way that the compound may be localized in a specific position (either inside or on the surface) of each grain.

As one preferred embodiment of the present invention, the tellurium compound may be incorporated into the silver halide grains in accordance with the distribution of the previously mentioned iron compound. For instance, 80% or more of the tellurium compound added is localized in the surface layer of each silver halide grain corresponding to up to 50%, preferably 40% or less, more preferably 20% or less, of the grain volume from the surface of the grain.

By introducing the tellurium compound along with the above-mentioned iron compound into the high silver chloride emulsion grains, the object of the present invention to elevate the sensitivity of the grains while inhibiting the generation of fog thereof, and to minimize sensitivity fluctuations of the grains due to variations in the ambient temperature during exposure may noticeably be achieved. In order to incorporate the tellurium compound into the desired position of each silver halide grain, a silver halide grain core without the surface layer is first formed, and then the tellurium compound is added to the resulting core, along with a water-soluble silver salt solution and an aqueous halide solution, in order to form the surface layer on the core.

The mean grain size of the silver halide grains to be contained in the silver halide emulsion for use in the present invention is preferably from 0.1 μm to 2 μm. (The grain size of each grain is represented by the diameter of a circle equivalent to the projected area of the grain, and the mean grain size is represented by the average of the grain sizes of all the grains.)

The fluctuation coefficient of the grain size distribution of the grains (which is obtained by dividing the standard deviation of the grain size distribution by the mean grain size) is desired to be 20% or less, more preferably 15% or less. That is, a so-called monodispersed emulsion is preferred. In order to obtain a broader latitude, a blend of different mono-dispersed emulsions is preferably incorporated into the same layer, or such different mono-dispersed emulsions may be incorporated into multiple layers which are overlaid on a support.

Regarding the shape of the silver halide grains to be in the photographic emulsions for use in the present invention, the grains are preferably regular crystalline ones such as a cubic, tetradecahedral or octahedral grains. If desired, they may also contain irregular crystalline ones such as spherical or tabular ones In the present invention, preferred are emulsions containing 50% or more, preferably 70% or more, more preferably 90% or more, of the above-mentioned regular crystalline grains.

In addition, also preferred are emulsions containing more than 50%, as the projected area of the total grains, of tabular grains having a mean aspect ratio (circle-equivalent diameter/thickness) of 5 or more, preferably 8 or more.

The silver halide photographic emulsion of the present invention may be prepared by known methods, for example, by those described in P. Glafkides, *Chimie et Physique Photographique* (published by Paul Montel Co., 1967); G. F. Duffin, *Photographic Emulsion Chemistry* (published by Focal Press Co., 1966); and V. L. Zelikman et al, *Making and Coating Photographic Emulsion* (published by Focal Press Co., 1964). For instance, they may be prepared by methods such as an acid method, a neutral method or an ammonia method. As a system of reacting a soluble silver salt and soluble halogen salt(s), any of a single jet method, a double jet method, or a combination of them may be employed. A so-called reverse mixing method may also be employed, in which silver halide grains are formed in an atmosphere which contains excess silver ions. As one system of a double jet method, a so-called controlled double jet method in which the silver ion concentration (pAg) in the liquid phase of the process to form the silver halide grains is kept constant may also be employed. By using this method, monodispersed silver halide grains each having a regular crystalline form can be obtained.

In addition to the iron compound and the tellurium compound, the silver halide emulsions of the present invention can also contain various polyvalent metal impurities, which are introduced during the formation of the emulsion grains or during physical ripening of them, for the purpose of the above-mentioned objects. As examples of compounds usable for the purpose, mentioned are salts of cadmium, zinc, lead, copper or thallium, as well as salts or complex salts of rhenium or of elements of Group VII of the Periodic Table, and salts or complex salts of elements of Group VIII of the Periodic Table, such as ruthenium, rhodium, palladium, osmium, iridium or platinum. In particular, preferred are the above-mentioned elements of Group VIII. The amount of these compounds to be added may vary over a broad range and is preferably from $10^{-9}$ to $10^{-2}$ mol per mol of silver halide.

The silver halide photographic emulsion of the present invention is generally subjected to chemical sensitization and color sensitization.

For chemical sensitization of the emulsion, sulfur sensitization may be used with, for example, unstable sulfur group compounds, selenium sensitization, tellurium sensitization, noble metal sensitization such as, for example, gold sensitization, or reduction sensitization, or combination of them. Compounds which may be used for such chemical sensitization are those described in, for example, U.S. Pat. Nos. 1,574,944, 1,623,499, 2,399,083, 3,297,446, 3,297,447, 3,320,069, 3,408,196, 3,408,197, 3,442,653, 3,402,670, 3,591,385; French Patents 2,093,038, 2,093,209; JP-B-52-34491, JP-B-52-34492, JP-B-53-295, JP-B-57-22090; JP-A-59-180536, JP-A-59-185330, JP-A-59-181337, JP-A-59-187338, JP-A-59-192241, JP-A-60-150046, JP-A-60-151637, JP-A-61-246738; British Patents 255,846, 861,984; and H. E. Spencer et al., *Journal of Photographic Science,* Vol. 31, pages 158–169 (1983).

In addition to the above-mentioned unstable sulfur group compounds, also preferred are compounds as described in JP-A 62-215272, from page 18, right bottom column to page 22, right top column.

Color sensitization is used in order to make the silver halide photographic emulsion of the present invention spectrally sensitive to a desired light wavelength range. In the present invention, color sensitization is preferably effected by adding to the emulsion a dye (color sensitizing dye) having absorption in a wavelength range of the intended color sensitivity. As examples of color sensitizing dyes usable for the purpose mentioned are those described in F. M. Hamer, *Heterocyclic Compounds—Cyanine dyes and related compounds* (published by John Wiley & Sons, New York, London, 1964). Specific examples of compounds for color sensitization, as well as color sensitizing methods are described in, for example, the above-mentioned JP-A-62-215272, from page 22, right top column to page 38; and these are preferably used in the present invention.

Various compounds and precursors may be added to the silver halide photographic emulsion of the present invention in order to prevent fogging of the emulsion during manufacture, storage and development of the photographic materials, or for the purpose of stabilizing the photographic properties of the materials. Specific examples of such compounds which are preferably used in the present invention are also described in the above-mentioned JP-A-62-215272, pages 39 to 72.

The silver halide photographic material of the present invention is preferably in the form of a so-called surface latent image type emulsion which forms a latent image essentially on the surfaces of the grains therein.

The silver halide grains which constitute the silver halide emulsion of the present invention comprise silver chlorobromide, silver chloroiodide, silver chloroiodobromide or silver chloride having a silver chloride content of 90 mol % or more. Particularly for the purpose of effecting rapid processing, the silver chloride content in the silver chlorobromide, silver chloroiodide, silver chloroiodobromide or silver chloride grains is preferably 95 mol % or more, more preferably 98 mol % or more. In general, the emulsion grains are substantially free from silver iodide for effectively achieving rapid processing. However, when panchromatic sensitization or infrared sensitization is applied to the emulsion, it may preferably contain a slight amount (generally, approximately from 0.01 mol % to 2 mol %) of silver iodide.

Preferably, the photographic material of the present invention may contain, in the hydrophilic colloid layer, dyes (especially oxonol dyes) as described in European Patent 0,337,490A, pages 27 to 76, which may be decolored by photographic processing, to such a degree that the optical reflection of the material at 680 nm may be 0.70 or more, in order to improve the sharpness of the image to be formed in the material; or the photographic material of the present invention may also contain, in the water-proof resin layer of the support, titanium oxide as surface-treated with a dihydric to tetrahydric alcohol (e.g., trimethylolethane), in an amount of 12% by weight or more, preferably 14% by weight or more.

High boiling point organic solvents for photographic additives, such as cyan, magenta and yellow couplers, to be added to the photographic material of the present invention are water-immiscible compounds having a melting point of 100° C. or lower and a boiling point of 140° C. or higher, and any and every good solvent for such couplers is usable. The melting point of such high boiling point organic solvents is preferably 80° C. or lower; and the boiling point of them is preferably 160° C. or higher, more preferably 170° C. or higher.

The details of such high boiling point organic solvents are described in JP-A-62-215272, from page 137, right bottom column to page 144, right top column.

For incorporating cyan, magenta and yellow couplers into the photographic material of the present invention, they may be immersed into a loadable latex polymer (for example, as described in U.S. Pat. No. 4,203,716) in the presence or absence of the above-mentioned high boiling point organic solvent or may be dissolved in a water-insoluble and organic solvent-soluble polymer, prior to being emulsified and dispersed in an aqueous hydrophilic colloid solution, and the resulting colloidal dispersion may be added to the emulsion constituting the photographic material.

For this purpose, preferably used are homopolymers and copolymers as described in U.S. Pat. No. 4,857,449, columns 7 to 15, and International Patent Laid-Open No. WO88/00723, pages 12 to 30. More preferably used are methacrylate or acrylamide polymers, especially preferably acrylamide polymers, for the purpose of attaining color image stabilization.

The photographic material of the present invention preferably contains a color image preservability improving compound, for example, one as described in European Patent 0,277,589A2, along with couplers. Incorporation of such a color image preservability improving compound into the material along with a pyrazoloazole coupler is preferred.

Specifically, single or combined incorporation of a compound (F) which may bind with the aromatic amine developing agent remains in the photographic material after color development thereof by chemical bond between them to form a chemically inactive and substantially colorless compound and/or a compound (G) which may bind with the oxidation product of an aromatic amine developing agent remains in the photographic material after color development thereof by chemical bond between them to form a chemically inactive and substantially colorless compound into the photographic material of the present invention is preferred for the purpose of preventing formation of color dyes by reaction of the color developing agent, or the oxidation product thereof as remained in the photographic material and to prevent couplers in the material during storage of the processed material from causing the formation of stains in the processed material during storage thereof, and also for preventing any other harmful side effect of the remaining agent and oxidation product of thereof.

The photographic material of the present invention also preferably contains an antifungal substance, such as described in JP-A-63-271247, for the purpose of preventing the propagation of various fungi and bacteria in the hydrophilic colloid layer of the processed material, which would deteriorate the image formed on the material.

As a support in the photographic material of the present invention, a white polyester support or a support having a white pigment-containing layer on the side which faces the silver halide emulsion layers as coated thereover may be employed for displays. In order to improve the sharpness of the image to be formed, it is preferred to provide an anti-halation layer on the support on either the side which faces the silver halide emulsion layers as coated thereover, or the opposite back side thereto. In particular, it is preferred to define the transmission density of the support to fall within the range of from 0.35 to 0.8, so that the display obtained using the photographic material of the present invention be may seen either with a reflecting light or a transmitting light.

The photographic material of the present invention may be exposed either with visible rays or with infrared rays. For exposure of the material, either low intensity exposure or high intensity short-time exposure may be employed. In particular, in the latter case, a short-time exposure system is preferred where the exposure time is shorter than $10^{-3}$ second per pixel; and a laser scanning exposure system is more preferred where the exposure time is shorter than $10^{-4}$ second per pixel.

In exposure of the photographic material of the present invention, a band stop filer as described in U.S. Pat. No. 4,880,726 is preferably used. Using it, rays causing color mixture may be removed so that the color reproducibility of the exposed material is improved noticeably.

The exposed photographic material of the present invention is processed for black-and-white development or color development. Where the material is a color photographic material, it is preferably subjected to bleach-fixation after color development thereof for the purpose of effectively achieving rapid processing of the material. In particular, when the material has the above-mentioned high silver chloride emulsion, the pH value of the bleach-fixing solution to be applied thereto is preferably about 6.5 or less, especially preferably about 6 or less, for the purpose of effectively accelerating desilvering of the material.

As silver halide emulsions and other elements (e.g., additives, etc.) which constitute the photographic material of the present invention, photographic layers constituting the material (e.g., arrangement of layers), methods of processing the material, and the additives to be used in the processing methods, those described in the following patent publications, especially in EP-0,355,660A2, are preferably employed.

| Photographic Elements | JP-A-62-215272 | JP-A-2-33144 | EP 0,355,660A2 |
|---|---|---|---|
| Silver Halide Emulsions | From page 10, right upper column, line 6 to page 12, lower column, line 5; and from page 12, right lower column, line 4 to page 13, left upper column, line 17 | From page 28, right upper column, line 16 to page 29, right lower column, line 11; and page 30, lines 2 to 5 | From page 45, line 53 to page 47, line 3; and page 47, lines 20 to 22 |
| Silver Halide Solvents | Page 12, left lower column, lines 6 to 14; and from page 13, left upper column, line 3 from below to page 18, left lower column, last line | — | — |
| Chemical Sensitizers | Page 12, from left lower column, line 3 from below to right lower column, line 5 from below; and from page 18, right lower column, line 1 to page 22, right upper column, line 9 from below | Page 29, right lower column, line 12 to last line | Page 47, lines 4 to 9 |
| Color Sensitizers | From page 22, right | Page 30, left upper | Page 47, lines 10 to |

-continued

| Photographic Elements | JP-A-62-215272 | JP-A-2-33144 | EP 0,355,660A2 |
|---|---|---|---|
| (Color Sensitizing Methods) | upper column, line 8 from below to page 38, last line | column, lines 1 to 13 | 15 |
| Emulsion Stabilizers | From page 39, left upper column, line 1 to page 72, right upper column, last line | Page 30, from left upper column, line 14 to right upper column, line 1 | Page 47, lines 16 to 19 |
| Development Promoters | From page 72, left lower column, line 1 to page 91, right upper column, line 3 | — | — |
| Color Couplers (Cyan, Magenta and Yellow Couplers) | From page 91, right upper column, line 4 to page 121, left upper column, line 6 | From page 3, right upper column, line 14 to page 18, left upper column, last line; and from page 30, right upper column, line 6 to page 35, right lower column, line 11 | Page 4, lines 15 to 27; from page 5, line 30 to page 28, last line; page 45, lines 29 to 31; and from page 47, line 23 to page 63, line 50 |
| Coloring Enhancers | From page 121, left upper column, line 7 to page 125, right upper column, line 1 | — | — |
| Ultraviolet Absorbents | From page 125, right upper column, line 2 to page 127, left lower column, last line | From page 37, right lower column, line 14 to page 38, left upper column line 11 | Page 65, lines 22 to 31 |
| Anti-fading Agents (Color Image Stabilizer) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 to 40; and page 65; lines 2 to 21 |
| High Boiling Point and/or Low Boiling Point Organic Solvents | From page 137, left lower column, line 9 to page 144, right upper column, last line | From page 35, right lower column, line 14 to page 36, left upper column, line 4 from below | Page 64, lines 1 to 51 |
| Dispersing Methods of Photographic Additives | From page 144, left lower column, line 1 to page 146, right upper column, line 7 | From page 27, right lower column, line 10 to page 28, left upper column, last line; and from page 35, right lower column, line 12, to page 36, right upper column, line 7 | From page 63, line 51 to page 64, line 56 |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Development Inhibitor Releasing Compounds | Page 155, right lower column, line 3 to 9 | — | — |
| Supports | From page 155, right lower column, line 19 to page 156, left upper column, line 14 | From page 38, right upper column, line 18 to page 39, left upper column, line 3 | From page 66, line 29 to page 67, line 13 |
| Constitution of Photographic Layers | Page 156, from left upper column, line 15 to right lower column, line 14 | Page 28, right upper column, lines 1 to 15 | Page 45, lines 41 to 52 |
| Dyes | From page 156, right lower column, line 15 to page 184, right lower column, last line | Page 38, from left upper column, line 12 to right upper column, line 7 | Page 66, lines 18 to 22 |
| Color Mixing Preventing Agents | From page 185, left upper column, line 1 to page 188, right lower column, line 3 | Page 36, right lower column, lines 8 to 11 | From page 64, line 57 to page 65, line 1 |
| Gradation Adjusting Agents | Page 188, right lower column, lines 4 to 8 | — | — |
| Stain Inhibitors | From page 188, right lower column, line 9 to page 193, right | Page 37, from left upper column, last line to right lower | From page 65, line 32 to page 66, line 17 |

-continued

| Photographic Elements | JP-A-62-215272 | JP-A-2-33144 | EP 0,355,660A2 |
|---|---|---|---|
| | lower column, line 10 | column, line 13 | |
| Surfactants | From page 201, left lower column, line 1 to page 210, right upper column, last one | From page 18, right upper column, line 1 to page 24, right lower column, last line; and page 27, from left lower column, line 10 from below to right lower column, line 9 | — |
| Fluorine-containing Compounds (as antistatic agents, coating aids, lubricants, and anti-blocking agents) | From page 210, left lower column, line 1 to page 222, left lower column, line 5 | From page 25, left upper column, line 1 to page 27, right lower column, line 9 | — |
| Binders (hydrophilic colloids) | From page 222, left lower column, line 6 to page 225, left upper column, last line | Page 38, right upper column, lines 8 to 18 | Page 66, lines 23 to 28 |
| Tackifiers | From page 225, right upper column, line 1 to page 227, right upper column, line 2 | — | — |
| Antistatic Agents | From page 227, right upper column, line 3 to page 230, left upper column, line 1 | — | — |
| Polymer Latexes | From page 230, left upper column, line 2 to page 239, last line | — | — |
| Mat Agents | Page 240, from left upper column, line 1 right upper column, last line | — | — |
| Photographic Processing Methods (Processing steps and additives) | From page 3, right upper column, line 7 to page 10, right upper column, line 5 | From page 39, left upper column, line 4 to page 42, left upper column, last line | From page 67, line 14 to page 69, line 28 |

The cited specification of JP-A-62-215272 is the one as amended by the letter of amendment filed on March 16, 1987.
Of the above-mentioned color couplers, so-called shortwave type yellow couplers as described in JP-A-63-231451, JP-A-63-123047, JP-A-63-241547, JP-A-1-173499, JP-A-1-213648 and JP-A-1-250944 are also preferably used as yellow couplers.

As cyan couplers, also preferred in the present invention are diphenylimidazole cyan couplers as described in JP-A-2-33144, as well as 3-hydroxypyridine cyan couplers as described in EP-0,333,185A2 (especially, a 2-equivalent coupler as modified from the illustrated 4-equivalent coupler (42) by incorporating chlorine split-off groups thereinto, as well as the illustrated couplers (6) and (9)), and cyclic active methylene cyan couplers as described in JP-A-64-32260 (especially, the illustrated couplers Nos. 3, 8 and 34).

For processing the silver halide color photographic material of the present invention which contains a high silver chloride emulsion having a silver chloride content of 90 mol % or more, the method described in JP-A-2-207250, from page 27, left top column to page 34, right top column is preferably employed.

The present invention will be explained in more detail by way of the following examples, which, however, are not intended to restrict the scope of the present invention.

EXAMPLE 1

6.4 g of sodium chloride was added to an aqueous 3% solution of a lime-processed gelatin, and 3.2 ml of N,N'-dimethylimidazolidine-2-thione (in the form of an aqueous 1% solution) was added thereto. An aqueous solution containing 0.2 mol of silver nitrate and an aqueous solution containing 0.08 mol of potassium bromide and 0.12 mol of sodium chloride were added to and blended with this, with vigorous stirring at 52° C. Subsequently, an aqueous solution containing 0.6 mol of silver nitrate and an aqueous solution containing 0.24 mol of potassium bromide and 0.36 mol of sodium chloride were added to and blended with this, also under vigorous stirring at 52° C. Next, an aqueous solution containing 0.2 mol of silver nitrate and an aqueous solution containing 0.08 mol of potassium bromide, 0.12 mol of sodium chloride and 0.04 mg of potassium hexachloroiridate(IV) were added to and blended with this, still vigorously stirring at 52° C. After being kept at 52° C. for 5 minutes, the resulting mixture was desalted and washed with water. Further, 90.0 g of a lime-processed gelatin was added thereto, and $4\times10^{-5}$ mol per mol of silver halide, of the following color sensitizing dye (a) was added thereto along with triethylthiourea and nucleic acid for effecting optimum chemical sensitization and color sensitization. The silver chlorobromide emulsion (having a silver bromide content of 40 mol %) thus obtained is called Emulsion (A-1).

Emulsion (A-2) was prepared in the same manner as above, except that $1.2\times10^{-6}$ mol per mol of silver halide, of the previously mentioned tellurium compound (II-15) was added to the aqueous halide solution to be added last (or in the third step).

Emulsion (A-3) was prepared in the same manner as above, except that $1.2\times10^{-6}$ mol per mol of silver halide, of the previously mentioned tellurium compound (II-10) was added to the aqueous halide solution to be added last (or in the third step).

Next, 3.3 g of sodium chloride was added to an aqueous 3% solution of a lime-processed gelatin, and 3.2 ml of N,N'-dimethylimidazolidine-2-thione (in the form of an aqueous 1% solution) was added thereto. An aqueous solution containing 0.2 mol of silver nitrate and an aqueous solution containing 0.2 mol of sodium chloride were added to and blended with this, with vigorous stirring at 52° C. Subsequently, an aqueous solution containing 0.6 mol of silver nitrate and an aqueous solution containing 0.6 mol of sodium chloride were added to and blended with this, also under vigorous stirring at 52° C. Next, an aqueous solution containing 0.2 mol of silver nitrate and an aqueous solution containing 0.2 mol of sodium chloride were added to and blended with this, still vigorously stirring at 52° C. After being kept at 52° C. for 5 minutes, the resulting mixture was desalted and washed with water. Further, 90.0 g of a lime-processed gelatin was added thereto, and $4\times10^{-5}$ mol per mol of silver halide, of the following color sensitizing dye (a) and 1.2 mol %, to silver halide, of a fine silver bromide grain emulsion (having a mean grain size of 0.05 μ, and containing $1.5\times10^{-4}$ mol per mol of silver bromide, of potassium hexachloroiridate(IV)) were added thereto along with triethylthiourea and nucleic acid for effecting optimum chemical sensitization and color sensitization. The silver chloride emulsion thus obtained is called Emulsion (B-1).

Emulsion (B-2) was prepared in the same manner as in preparation of Emulsion (B-1), except that $1.2\times10^{-6}$ mol per mol of silver halide, of the previously mentioned tellurium compound (II-15) was added to the aqueous halide solution to be added last (or in the third step).

Emulsion (B-3) was prepared in the same manner as in preparation of Emulsion (B-1), except that $1.2\times10^{-6}$ mol per mol of silver halide, of the previously mentioned tellurium compound (II-10) was added to the aqueous halide solution to be added last (or in the third step).

Next, Emulsion (C-1) was prepared in the same manner as in preparation of Emulsion (B-1), except that potassium hexacyanoferrate(II) trihydrate was added to all the three aqueous sodium chloride solutions as added for formation of the grains, each in an amount of 0.84 mg, 2.53 mg and 0.84 mg, respectively.

Emulsion (C-2) was prepared in the same manner as in preparation of Emulsion (C-1), except that $1.2\times10^{-6}$ mol per mol of silver halide, of the previously mentioned tellurium compound (II-15) was added to the aqueous halide solution to be added last (or in the third step).

Emulsion (C-3) was prepared in the same manner as in preparation of Emulsion (C-1), except that $1.2\times10^{-6}$ mol per mol of silver halide, of the previously mentioned tellurium compound (II-10) was added to the aqueous halide solution to be added last (or in the third step).

Next, Emulsion (D-1) was prepared in the same manner as in preparation of Emulsion (B-1), except that 4.22 mg of potassium hexacyanoferrate(II) trihydrate was added to the aqueous sodium chloride solution to be added last (or in the third step).

Emulsion (D-2) was prepared in the same manner as in preparation of Emulsion (D-1), except that $1.2\times10^{-6}$ mol per mol of silver halide, of the previously mentioned tellurium compound (II-15) was added to the aqueous halide solution to be added last (or in the third step).

Emulsion (D-3) was prepared in the same manner as in preparation of Emulsion (D-1), except that $1.2\times10^{-6}$ mol per mol of silver halide, of the previously mentioned tellurium compound (II-10) was added to the aqueous halide solution to be added last (or in the third step).

The silver halide grains in all of these twelve kinds of emulsions thus prepared had almost the same size, or they were cubic grains having a mean edge length of 0.5 μ and having a fluctuation coefficient of grain size of 0.08.

The halogen composition of each of the emulsions prepared above and the presence or absence of iron compound and/or tellurium compound in the grains in each emulsion are shown in Table 1 below.

Next, 38.0 g of cyan coupler (b), 17.0 g of color image stabilizer (c) and 35.0 g of color image stabilizer (d) were dissolved in 40.0 ml of ethyl acetate and 23.0 g of solvent (e), and the resulting solution was emulsified and dispersed in 400 ml of an aqueous 10% gelatin solution containing 20 ml of 10% sodium dodecylbenzenesulfonate.

$1.0\times10^{-3}$ mol per mol of silver halide, of the following compound (f) was added to each of the previously prepared twelve red-sensitive emulsions; and the above-mentioned coupler dispersion was added thereto. Thus, coating liquids each having the composition as shown in Table 2 below were prepared. Each coating liquid was coated on a paper support, both surfaces of which had been laminated with polyethylene, to have the layer constitution of Table 2. Thus, twelve photographic material samples were prepared. As a gelatin hardening agent, 1-hydroxy-3,5-dichloro-s-triazine sodium salt was added to each layer.

TABLE 1

| Emulsion | Halogen Composition | Iron Compound | Tellurium Compound |
|---|---|---|---|
| A-1 | $AgCl_{60}Br_{40}$ | No | No |
| A-2 | $AgCl_{60}Br_{40}$ | No | Tellurium compound (II-15) (contained in 20% of surface layer) $1.2\times10^{-6}$ mol/mol of Ag |
| A-3 | $AgCl_{60}Br_{40}$ | No | Tellurium compound (II-10) (contained in 20% of surface layer) $1.2\times10^{-6}$ mol/mol of Ag |
| B-1 | $AgCl_{98.8}Br_{1.2}$ | No | No |
| B-2 | $AgCl_{98.8}Br_{1.2}$ | No | Tellurium compound (II-15) (contained in 20% of surface layer) $1.2\times10^{-6}$ mol/mol of Ag |
| B-3 | $AgCl_{98.8}Br_{1.2}$ | No | Tellurium compound (II-10) (contained in 20% of surface layer) |

TABLE 1-continued

| Emulsion | Halogen Composition | Iron Compound | Tellurium Compound |
|---|---|---|---|
| | | | $1.2 \times 10^{-6}$ mol/mol of Ag |
| C-1 | $AgCl_{98.8}Br_{1.2}$ | Potassium hexacyanoferrate (II) (uniformly contained) $1 \times 10^{-5}$ mol/mol of Ag | No |
| C-2 | $AgCl_{98.8}Br_{1.2}$ | Potassium hexacyanoferrate (II) (uniformly contained) $1 \times 10^{-5}$ mol/mol of Ag | Tellurium compound (II-15) (contained in 20% of surface layer) $1.2 \times 10^{-6}$ mol/mol of Ag |
| C-3 | $AgCl_{98.8}Br_{1.2}$ | Potassium hexacyanoferrate (II) (uniformly contained) $1 \times 10^{-5}$ mol/mol of Ag | Tellurium compound (II-10) (contained in 20% of surface layer) $1.2 \times 10^{-6}$ mol/mol of Ag |
| D-1 | $AgCl_{98.8}Br_{1.2}$ | Potassium hexacyanoferrate (II) (contained in 20% of surface layer) $1 \times 10^{-5}$ mol/mol of Ag | No |
| D-2 | $AgCl_{98.8}Br_{1.2}$ | Potassium hexacyanoferrate (II) (contained in 20% of surface layer) $1 \times 10^{-5}$ mol/mol of Ag | Tellurium compound (II-15) (contained in 20% of surface layer) $1.2 \times 10^{-6}$ mol/mol of Ag |
| D-3 | $AgCl_{98.8}Br_{1.2}$ | Potassium hexacyanoferrate (II) (contained in 20% of surface layer) $1 \times 10^{-5}$ mol/mol of Ag | Tellurium compound (II-10) (contained in 20% of surface layer) $1.2 \times 10^{-6}$ mol/mol of Ag |

The compounds used above are as follows:

(a) Color Sensitizing Dye:

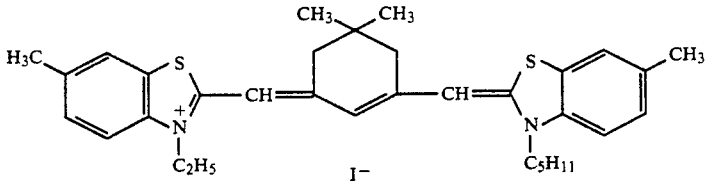

(b) Cyan Coupler:

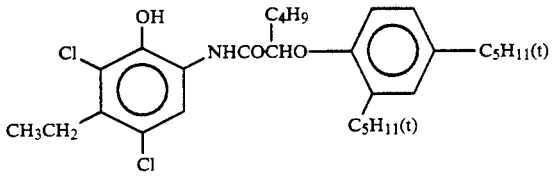

(c) Color Image Stabilizer:

1/3/3 mixture (by mol) of the following compounds:

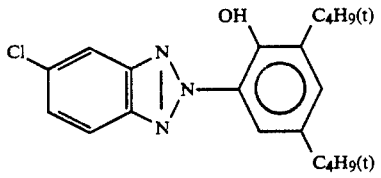

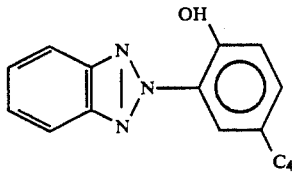

and

-continued

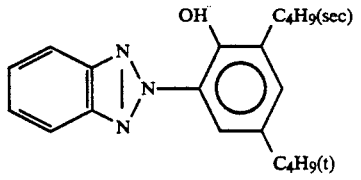

(d) Color Image Stabilizer:

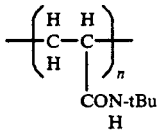

(number average molecular weight: 60,000)

(e) Solvent:

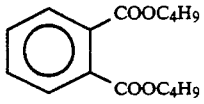

(f):

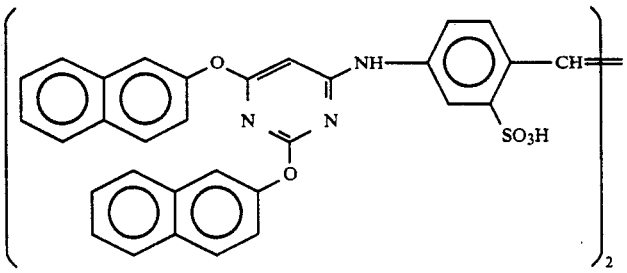

TABLE 2

| Layer | Components | |
|---|---|---|
| 2nd layer (protective layer) | Gelatin | 1.50 g/m$^2$ |
| 1st layer (red-sensitive layer) | Silver chlorobromide (chloride) emulsion (selected from A-1 to A-3, B-1 to B-3, C-1 to C-3, D-1 to D-3) | 0.24 g/m$^2$ as Ag |
| | Cyan coupler (b) | 0.38 g/m$^2$ |
| | Color image stabilizer (c) | 0.17 g/m$^2$ |
| | Color image stabilizer (d) | 0.35 g/m$^2$ |
| | Solvent (e) | 0.23 g/m$^2$ |
| | Gelatin | 1.00 g/m$^2$ |
| Support | Polyethylene-laminated paper support (containing $TiO_2$ and ultramarine in polyethylene below 1st layer) | |

The twelve different coated samples (each called by the same code name as the emulsion therein) thus prepared were each tested with respect to the emulsion therein in the manner discussed below.

Precisely, each sample was subjected to exposure of 0.1 second and 250 CMS with a sensitometer (FWH Model, manufactured by Fuji Photo Film Co.) at room temperature (24° C.), through an optical wedge and a red filter (Fuji Optical filter SP-3 Model) and then color-developed in accordance with the color development process using the color developer mentioned below. The color development was effected for time periods of 20 seconds and 45 seconds so as to evaluate the rapid processability of each sample.

The reflection density of each of the resulting processed samples was measured to obtain a so-called characteristic curve. The fog density, the relative sensitivity and the contrast of each sample were obtained from the characteristic curve. The relative sensitivity is represented by a reciprocal of the exposure amount giving a higher density than the fog density by 0.5, being based on the control sensitivity of sample (A-1) as being 100. The contrast is represented by the increment of the color density at the point where the sensitivity was obtained, by increasing the exposure amount by 0.5 log E. Next, in order to examine how the photographic property of each sample fluctuates when the ambient temperature during exposure of each sample varies, each sample was subjected to exposure of 0.1 second and 250 CMS at temperatures of 15° C. and 35° C., and then developed. From the characteristic curve thus obtained, the difference in the exposure amount giving a higher density than the fog density of 1.0 between the two cases (15° C. and 35° C. for exposure) was obtained as the sensitivity fluctuation due to variation in the ambient temperature during exposure, which was represented by a unit of log E.

The results obtained are shown in Table 3 below.

TABLE 3

| Sample | Exposure for 0.1 second at room temperature (24° C.) Developed for 20 seconds fog | sensitivity | contrast | Developed for 45 seconds fog | sensitivity | contrast | Difference in sensitivity between 15° C.-0.1 second exposure and 35° C.-0.1 second exposure Difference in exposure amount (log E) to give reflection density of (fog + 1.0) | Remarks |
|---|---|---|---|---|---|---|---|---|
| A-1 | 0.08 | 25 | 0.41 | 0.09 | 100 | 0.78 | 0.07 | comparative sample |
| A-2 | 0.11 | 28 | 0.41 | 0.15 | 114 | 0.79 | 0.06 | comparative sample |
| A-3 | 0.13 | 31 | 0.40 | 0.19 | 116 | 0.77 | 0.05 | comparative sample |
| B-1 | 0.08 | 86 | 1.38 | 0.09 | 131 | 1.41 | 0.21 | comparative sample |
| B-2 | 0.21 | 86 | 1.32 | 0.28 | 135 | 1.39 | 0.16 | comparative sample |
| B-3 | 0.29 | 84 | 1.31 | 0.42 | 132 | 1.36 | 0.14 | comparative sample |
| C-1 | 0.08 | 123 | 1.45 | 0.09 | 183 | 1.47 | 0.13 | comparative sample |
| C-2 | 0.10 | 133 | 1.42 | 0.12 | 197 | 1.44 | 0.07 | sample of the invention |
| C-3 | 0.12 | 142 | 1.43 | 0.14 | 211 | 1.43 | 0.05 | sample of the invention |
| D-1 | 0.08 | 304 | 1.50 | 0.09 | 422 | 1.53 | 0.09 | comparative sample |
| D-2 | 0.09 | 363 | 1.47 | 0.11 | 502 | 1.50 | 0.05 | sample of the invention |
| D-3 | 0.10 | 375 | 1.46 | 0.12 | 520 | 1.51 | 0.03 | sample of the invention |

Processing steps for the color development of the samples are as follows:

| Steps | Temperature | Time |
|---|---|---|
| Color Development | 35° C. | 20 sec, 45 sec |
| Bleach-fixation | 35° C. | 45 sec |
| Rinsing (1) | 30 to 35° C. | 20 sec |
| Rinsing (2) | 30 to 35° C. | 20 sec |
| Rinsing (3) | 30 to 35° C. | 20 sec |
| Rinsing (4) | 30 to 35° C. | 30 sec |
| Drying | 70 to 80° C. | 60 sec |

Rinsing was effected by a 4-tank countercurrent system from rinsing tank (4) to rinsing tank (1).

The compositions of the processing solutions used above are as follows:

| | |
|---|---|
| Color Developer: | |
| Water | 800 ml |
| Ethylenediamine-N,N,N',N'-tetramethylenephosphonic Acid | 1.5 g |
| Potassium Bromide | 0.015 g |
| Triethanolamine | 8.0 g |
| Sodium Chloride | 1.4 g |
| Potassium Carbonate | 25.0 g |
| N-ethyl-N-(β-methanesulfonamidoethyl)-3-methyl-4-aminoaniline Sulfate | 5.0 g |
| N,N-bis(carboxymethyl)hydrazine | 4.0 g |
| N,N-di(sulfoethyl)hydroxylamine Monosodium Salt | 4.2 g |
| Brightening Agent (WHITEX 4B, produced by Sumitomo Chemical Co.) | 1.0 g |
| Water to make | 1000 ml |
| pH (25° C.) | 10.10 |
| Bleach-fixing Solution: | |
| Water | 400 ml |
| Ammonium Thiosulfate (700 g/liter) | 100 ml |
| Sodium Sulfite | 17.0 g |
| Ammonium Ethylenediaminetetraacetato/Iron(III) | 55.0 g |
| Disodium Ethylenediaminetetraacetate | 5.0 g |
| Ammonium Bromide | 40.0 g |
| Glacial Acetic Acid | 6.0 g |
| Water to make | 1000 ml |
| pH (25° C.) | 6.00 |

-continued

| | |
|---|---|
| Rinsing Solution: | |
| Ion-exchanged water (having calcium and magnesium content of each 3 ppm or less). | |

From the results in Table 3 above, the advantageous effects of the present invention are shown. Precisely, sample (A-1) containing an emulsion having a silver bromide content of 40 mol % involved little sensitivity fluctuation when the ambient temperature during exposure varied, but the development rate thereof was slow. Since the contrast of the sample (A-1) was noticeably low under the tested conditions, practical use of the sample is impossible. Samples (A-2) and (A-3), each containing an emulsion to which the tellurium compound had been added during formation of the silver halide grains therein, still had the drawback that the development rate is slow, though they each had a somewhat elevated sensitivity. The sensitivity in Table 3 is a relative value with respect to the sensitivity of sample (A-1) as developed for 45 seconds as being 100.

Sample (B-1), which contains an emulsion having a silver chloride content of 98.8 mol % had an extremely elevated development rate and gave a high contrast even by rapid processing. However, it had a low sensitivity and could not be put to practical use. In addition, the sensitivity fluctuation of the sample (B-1) due to variations in the ambient temperature during exposure was noticeably large. Samples (B-2) and (B-3), each containing an emulsion to which the tellurium compound had been added during formation of the grains therein, still involved noticeable elevation of the fog, though they each had a somewhat elevated sensitivity and involved somewhat reduced sensitivity fluctuation due to variations in the ambient temperature during exposure. Therefore, they could not be put to practical use.

In contrast to the above samples, sample (C-1), which contains a silver chloride emulsion to which the iron compound had been added, was noted to have an elevated sensitivity and involve a reduction of the sensitivity fluctuation due to variations in the ambient temperature during exposure. By further addition of the tellurium compound during formation of the grains to this sample (see samples (C-2) and (C-3)), the sensitivity was elevated even more, and the temperature-dependence during exposure was further reduced. The increase in the fog of these samples (C-2) and (C-3) due to addition of the tellurium compound was small. The effects are even more remarkable when the iron compound and the tellurium compounds were concentratedly incorporated into the area near to the surface of each grain. (Sample (D-1) as compared with sample (D-2) and sample (D-3).)

In accordance with the present invention, therefore, photographic materials which may be processed by rapid processing, and which have a high sensitivity and a high contrast and involve little sensitivity fluctuations due to variations in the ambient temperature during exposure are obtained.

EXAMPLE 2

Infrared-sensitive emulsions (E-1) to (H-3) were prepared in the same manner as the twelve different kinds of emulsions (A-1) to (D-3) in Example 1, respectively, except that $5\times10^{-6}$ mol per mol of silver halide, of the following color sensitizing dye (g) was used in place of the sensitizing dye (a). Each of them was combined with the same emulsified dispersion of the cyan color-forming coupler as that in Example 1 to give twelve kinds of coated samples. These were subjected to a photographic property test in the manner mentioned below.

Precisely, each sample was exposed for $10^{-3}$ second at room temperature (24° C.), using SENSITOMETER Mark VII (manufactured by EG & G Co.), through an optical wedge and an infrared-permeable red filter (Fuji Optical Filter SP-3 Model) and then color-developed in the same manner as described in Example 1.

Next, these were also exposed for $10^{-3}$ second, with varying the ambient temperature to 15° C. and 35° C. in the same manner as in Example 1, and then developed.

From the reflection density of each of the resulting processed samples, the fog, contrast and relative sensitivity of each of them as exposed at room temperature were obtained, and the sensitivity fluctuation of each of the samples as exposed at the varied ambient temperature was obtained.

The results thus obtained are shown in Table 4 below.

From the results in Table 4, it is noted that the effect of the present invention is more noticeable in the case of high-intensity and short-time exposure of the samples each containing an infrared-sensitized emulsion.

Specifically, samples (E-1) to (E-3) each containing an emulsion having a silver bromide content of 40% involved little sensitivity fluctuation due to variations in the ambient temperature during exposure, but the development rate of these samples was much longer. In contrast, samples (F-1) to (F-3) each containing an emulsion having a silver chloride content of 98.8 mol % could be developed by rapid processing, but the contrast of these samples was unsatisfactory when they were exposed by high-intensity exposure. In addition, the temperature-dependence of the sensitivity of these samples in high-intensity exposure was large. The addition of the tellurium compound to these samples alleviated, these drawbacks somewhat, but not to a sufficient extent.

The combined addition of the iron compound and the tellurium compound in accordance with the present invention in samples (G-1) to (G-3) resulted in an elevated sensitivity and an elevated contrast and involved little temperature-dependence during exposure. Like the results in Example 1, the effect of the present invention is even more noticeable in the emulsions having silver halide grains where the iron compound and the tellurium compound were concentratedly incorporated into the surface layer of each grain therein (Sample (H-1) as compared with Sample (H-2) and Sample (H-3)).

Compound (g) used is as follows:

(g):

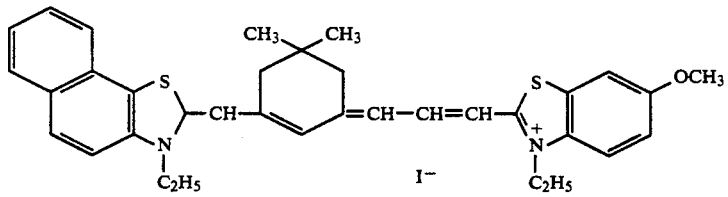

TABLE 4

| Sample | Exposure for $10^{-3}$ second at room temperature (24° C.) Developed for 20 seconds fog | sensitivity | contrast | Developed for 45 seconds fog | sensitivity | contrast | Difference in sensitivity between 15° C.-0.1 second exposure and 30° C.-0.1 second exposure Difference in exposure amount (log E) to give reflection density of (fog + 1.0) | Remarks |
|---|---|---|---|---|---|---|---|---|
| E-1 | 0.18 | 21 | 0.30 | 0.09 | 100 | 0.66 | 0.10 | comparative sample |
| E-2 | 0.12 | 26 | 0.28 | 0.16 | 123 | 0.69 | 0.10 | comparative sample |
| E-3 | 0.13 | 34 | 0.29 | 0.19 | 127 | 0.68 | 0.09 | comparative sample |
| F-1 | 0.18 | 65 | 1.32 | 0.09 | 105 | 1.35 | 0.29 | comparative sample |
| F-2 | 0.22 | 66 | 1.27 | 0.30 | 111 | 1.32 | 0.28 | comparative sample |

TABLE 4-continued

| Sample | Exposure for $10^{-3}$ second at room temperature (24° C.) Developed for 20 seconds fog | sensitivity | contrast | Developed for 45 seconds fog | sensitivity | contrast | Difference in sensitivity between 15° C.-0.1 second exposure and 30° C.-0.1 second exposure Difference in exposure amount (log E) to give reflection density of (fog + 1.0) | Remarks |
|---|---|---|---|---|---|---|---|---|
| F-3 | 0.30 | 64 | 1.29 | 0.45 | 108 | 1.31 | 0.27 | comparative sample |
| G-1 | 0.08 | 113 | 1.41 | 0.09 | 176 | 1.43 | 0.17 | comparative sample |
| G-2 | 0.10 | 129 | 1.36 | 0.13 | 217 | 1.40 | 0.10 | sample of the invention |
| G-3 | 0.11 | 137 | 1.38 | 0.14 | 215 | 1.39 | 0.08 | sample of the invention |
| H-1 | 0.08 | 266 | 1.48 | 0.09 | 417 | 1.51 | 0.13 | comparative sample |
| H-2 | 0.10 | 324 | 1.46 | 0.12 | 515 | 1.48 | 0.09 | sample of the invention |
| H-3 | 0.10 | 338 | 1.47 | 0.13 | 537 | 1.49 | 0.08 | sample of the invention |

EXAMPLE 3

Emulsion sample (I-1) was prepared in the same manner as in preparation of silver halide emulsion sample (B-1) in Example 1, except for the following points. Specifically, the temperature during formation of the emulsion grains was varied to 72° C. and the time of addition for the aqueous silver nitrate solution and the aqueous sodium chloride solution was varied in order to obtain an emulsion comprising cubic silver halide grains having a mean grain size of 0.91 μ and a fluctuation coefficient of grain size distribution of 6%. In place of the color sensitizing dye (a), color sensitizing dyes (A) and (B) mentioned below were each added in an amount of $2.0\times10^{-4}$ mol per mol of silver halide, and the fine silver bromide grains were changed to those having a mean grain size of 0.05 μ and containing $6.0\times10^{-5}$ mol per mol of silver bromide, of potassium hexachloroiridate(IV), the amount of the grains being varied to 0.35 mol % to silver halide, and the amount of the sulfur sensitizer of triethylthiourea was suitably adjusted to effect the optimum chemical sensitization.

Emulsion (I-2) was prepared in the same manner as emulsion (I-1), except that $0.4\times10^{-6}$ mol per mol of silver halide, of tellurium compound (II-10) was added to the aqueous sodium chloride solution to be added last (or in the third step) in forming the grains.

Next, emulsion sample (I-3) was prepared in the same manner as the silver halide emulsion sample (D-1) in Example 1, except for the following points. Specifically, the temperature during formation of the emulsion grains was varied to 72° C. and the time of addition for the aqueous silver nitrate solution and the aqueous sodium chloride solution was varied in order to obtain an emulsion comprising cubic silver halide grains having a mean grain size of 0.91 μ and a fluctuation coefficient of grain size distribution of 6%. In place of the color sensitizing dye (a), color sensitizing dyes (A) and (B) mentioned below were each added in an amount of $2.0\times10^{-4}$ mol per mol of silver halide, and the fine silver bromide grains were changed to those having a mean grain size of 0.05 μ and containing $6.0\times10^{-5}$ mol per mol of silver bromide, of potassium hexachloroiridate(IV), the amount of the grains being varied to 0.35 mol % to silver halide, and the amount of the sulfur sensitizer of triethylthiourea was suitably adjusted to effect the optimum chemical sensitization.

Emulsion (I-4) was prepared in the same manner as emulsion (I-3), except that $0.4\times10^{-6}$ mol per mol of silver halide, of tellurium compound (II-10) was added to the aqueous sodium chloride solution to be added last (or in the third step) in forming the grains.

Next, emulsion sample (J-1) was prepared in the same manner as the silver halide emulsion sample (B-1) in Example 1, except for the following points. Specifically, the temperature during formation of the emulsion grains was varied to 64° C. and the time of addition for the aqueous silver nitrate solution and the aqueous sodium chloride solution was varied in order to obtain an emulsion comprising cubic silver halide grains having a mean grain size of 0.71 μ and a fluctuation coefficient of grain size distribution of 7%. In place of the color sensitizing dye (a), color sensitizing dyes (A) and (B) mentioned below were each added in an amount of $2.5\times10^{-4}$ mol per mol of silver halide, and the fine silver bromide grains were changed to those having a mean grain size of 0.05 μ and containing $6.0\times10^{-5}$ mol per mol of silver bromide, of potassium hexachloroiridate(IV), the amount of the grains being varied to 0.6 mol % to silver halide, and the amount of the sulfur sensitizer of triethylthiourea was suitably adjusted to effect the optimum chemical sensitization.

Emulsion (J-2) was prepared in the same manner as emulsion (J-1), except that $0.9\times10^{-6}$ mol per mol of silver halide, of tellurium compound (II-10) was added to the aqueous sodium chloride solution to be added last (or in the third step) in forming the grains.

Next, emulsion sample (J-3) was prepared in the same manner as the silver halide emulsion sample (D-1) in Example 1, except for the following points. Specifically, the temperature during formation of the emulsion grains was varied to 64° C. and the time of addition for the aqueous silver nitrate solution and the aqueous sodium chloride solution was varied in order to obtain an emulsion comprising cubic silver halide grains having a mean grain size of 0.71 μ and a fluctuation coefficient of grain size distribution of 7%. In place of the color sensitizing dye (a), color sensitizing dyes (A) and (B) mentioned below were each added in an amount of $2.5\times10^{-4}$ mol per mol of silver halide, and the fine silver bromide grains were changed to those having a mean grain size of 0.05 μ and containing $6.0\times10^{-5}$ mol per mol of silver bromide, of potassium hexachloroiridate(IV), the amount of the grains being varied to 0.6 mol % to silver halide, and the amount of the sulfur sensitizer of triethylthiourea was suitably adjusted to effect the optimum chemical sensitization.

Emulsion (J-4) was prepared in the same manner as emulsion (J-3), except that $0.9\times10^{-6}$ mol per mol of silver halide, of tellurium compound (II-10) was added to the aqueous sodium chloride solution to be added last (or in the third step) in forming the grains.

Color sensitizing dyes as added to the blue-sensitive emulsion layer were as follows:

Sensitizing Dye A:

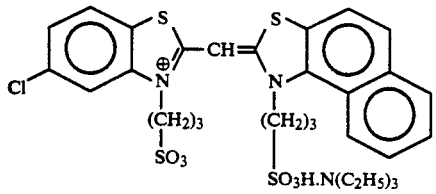

and

Sensitizing Dye B:

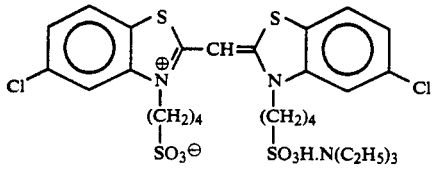

(Each was added in an amount of $2.0\times10^{-4}$ mol per mol of silver halide, to the large-size emulsion; and in an amount of $2.5\times10^{-4}$ mol per mol of silver halide, to the small-size emulsion.)

Next, emulsion sample (K-1) was prepared in the same manner as the silver halide emulsion sample (B-1) in Example 1, except for the following points. Specifically, the temperature during formation of the emulsion grains was varied to 56° C. and the time of addition for the aqueous silver nitrate solution and the aqueous sodium chloride solution was varied in order to obtain an emulsion comprising cubic silver halide grains having a mean grain size of 0.54 μ and a fluctuation coefficient of grain size distribution of 7%. In place of the color sensitizing dye (a), color sensitizing dyes (C) and (D) mentioned below were each added in an amount of $4.0\times10^{-4}$ mol and $7.0\times10^{-5}$ mol, respectively, per mol of silver halide, to the formed grains, and the amount of the sulfur sensitizer of triethylthiourea was suitably adjusted to effect the optimum chemical sensitization.

Emulsion (K-2) was prepared in the same manner as emulsion (K-1), except that $1.1\times10^{-6}$ mol per mol of silver halide, of tellurium compound (II-10) was added to the aqueous sodium chloride solution to be added last (or in the third step) in forming the grains.

Next, emulsion sample (K-3) was prepared in the same manner as the silver halide emulsion sample (D-1) in Example 1, except for the following points. Specifically, the temperature during formation of the emulsion grains was varied to 56° C. and the time of addition for the aqueous silver nitrate solution and the aqueous sodium chloride solution was varied in order to obtain an emulsion comprising cubic silver halide grains having a mean grain size of 0.54 μ and a fluctuation coefficient of grain size distribution of 7%. In place of the color sensitizing dye (a), color sensitizing dyes (C) and (D) mentioned below were each added in an amount of $4.0\times10^{-4}$ mol and $7.0\times10^{-5}$ mol, respectively, per mol of silver halide, to the formed grains, and the amount of the sulfur sensitizer of triethylthiourea was suitably adjusted to effect the optimum chemical sensitization.

Emulsion (K-4) was prepared in the same manner as emulsion (K-3), except that $1.1\times10^{-6}$ mol per mol of silver halide, of tellurium compound (II-10) was added to the aqueous sodium chloride solution to be added last (or in the third step) in forming the grains.

Next, emulsion sample (L-1) was prepared in the same manner as the silver halide emulsion sample (B-1) in Example 1, except for the following points. Specifically, the temperature during formation of the emulsion grains was varied to 54° C. and the time of addition for the aqueous silver nitrate solution and the aqueous sodium chloride solution was varied in order to obtain an emulsion comprising cubic silver halide grains having a mean grain size of 0.43 μ and a fluctuation coefficient of grain size distribution of 8%. In place of the color sensitizing dye (a), color sensitizing dyes (C) and (D) mentioned below were each added in an amount of $5.0\times10^{-4}$ mol and $1.0\times10^{-4}$ mol, respectively, per mol of silver halide, to the formed grains, and the amount of the sulfur sensitizer of triethylthiourea was suitably adjusted to effect the optimum chemical sensitization.

Emulsion (L-2) was prepared in the same manner as emulsion (L-1), except that $1.3\times10^{-6}$ mol per mol of silver halide, of tellurium compound (II-10) was added to the aqueous sodium chloride solution to be added last (or in the third step) in forming the grains.

Next, emulsion sample (L-3) was prepared in the same manner as the silver halide emulsion sample (D-1) in Example 1, except for the following points. Specifically, the temperature during formation of the emulsion grains was varied to 54° C. and the time of addition for the aqueous silver nitrate solution and the aqueous sodium chloride solution was varied in order to obtain an emulsion comprising cubic silver halide grains having a mean grain size of 0.43 μ and a fluctuation coefficient of grain size distribution of 8%. In place of the color sensitizing dye (a), color sensitizing dyes (C) and (D) mentioned below were each added in an amount of $5.6\times10^{-4}$ mol and $1.0\times10^{-4}$ mol, respectively, per mol of silver halide, to the formed grains, and the amount of the sulfur sensitizer of triethylthiourea was suitably adjusted to effect the optimum chemical sensitization.

Emulsion (L-4) was prepared in the same manner as emulsion (L-3), except that $1.3\times10^{-6}$ mol per mol of silver halide, of tellurium compound (II-10) was added to the aqueous sodium chloride solution to be added last (or in the third step) in forming the grains.

Color sensitizing dyes as added to the green-sensitive emulsion layer were as follows:

Sensitizing Dye C:

-continued

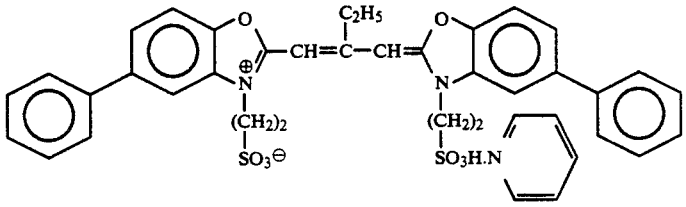

(This was added in an amount of $4.0\times10^{-4}$ mol per mol of silver halide, to the large-size emulsion; and in an amount of $5.6\times10^{-4}$ mol per mol of silver halide, to the small-size emulsion.)

Sensitizing Dye D:

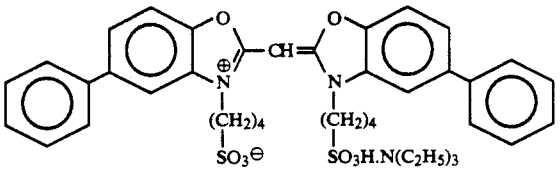

(This was added in an amount of $7.0\times10^{-5}$ mol per mol of silver halide, to the large-size emulsion; and in an amount of $1.0\times10^{-5}$ mol per mol of silver halide, to the small-size emulsion.)

Next, emulsion sample (M-1) was prepared in the same manner as the silver halide emulsion sample (B-1) in Example 1, except for the following points. Specifically, the time of addition for the aqueous silver nitrate solution and the aqueous sodium chloride solution was varied in order to obtain an emulsion comprising cubic silver halide grains having a mean grain size of 0.64 $\mu$ and a fluctuation coefficient of grain size distribution of 7%. The amount of the color sensitizing dye (a) was varied to $9.0\times10^{-5}$ mol per mol of silver halide, and the amount of the sulfur sensitizer of triethylthiourea was suitably adjusted to effect the optimum chemical sensitization.

Emulsion (M-2) was prepared in the same manner as emulsion (M-1), except that $1.0\times10^{-6}$ mol per mol of silver halide, of tellurium compound (II-10) was added to the aqueous sodium chloride solution to be added last (or in the third step) in forming the grains.

Next, emulsion sample (M-3) was prepared in the same manner as the silver halide emulsion sample (D-1) in Example 1, except for the following points. Specifically, the time of addition for the aqueous silver nitrate solution and the aqueous sodium chloride solution was varied in order to obtain an emulsion comprising cubic silver halide grains having a mean grain size of 0.64 $\mu$ and a fluctuation coefficient of grain size distribution of 7%. The amount of the color sensitizing dye (a) was varied to $9.0\times10^{-5}$ mol per mol of silver halide, and the amount of the sulfur sensitizer of triethylthiourea was suitably adjusted to effect the optimum chemical sensitization.

Emulsion (M-4) was prepared in the same manner as emulsion (M-3), except that $1.0\times10^{-6}$ mol per mol of silver halide, of tellurium compound (II-10) was added to the aqueous sodium chloride solution to be added last (or in the third step) in forming the grains.

Next, emulsion sample (N-1) was prepared in the same manner as the silver halide emulsion sample (B-1) in Example 1, except for the following points. Specifically, the time of addition for the aqueous silver nitrate solution and the aqueous sodium chloride solution was varied in order to obtain an emulsion comprising cubic silver halide grains having a mean grain size of 0.52 $\mu$ and a fluctuation coefficient of grain size distribution of 8%. The amount of the color sensitizing dye (a) was varied to $1.0\times10^{-4}$ mol per mol of silver halide, and the amount of the sulfur sensitizer of triethylthiourea was suitably adjusted to effect the optimum chemical sensitization.

Emulsion (N-2) was prepared in the same manner as emulsion (N-1), except that $1.2\times10^{-6}$ mol per mol of silver halide, of tellurium compound (II-10) was added to the aqueous sodium chloride solution to be added last (or in the third step) in forming the grains.

Next, emulsion sample (N-3) was prepared in the same manner as the silver halide emulsion sample (D-1) in Example 1, except for the following points. Precisely, the time of addition for the aqueous silver nitrate solution and the aqueous sodium chloride solution was varied in order to obtain an emulsion comprising cubic silver halide grains having a mean grain size of 0.52 $\mu$ and a fluctuation coefficient of grain size distribution of 8%. The amount of the color sensitizing dye (a) was varied to $1.1\times10^{-4}$ mol per mol of silver halide, and the amount of the sulfur sensitizer of triethylthiourea was suitably adjusted to effect the optimum chemical sensitization.

Emulsion (N-4) was prepared in the same manner as emulsion (N-3), except that $1.2\times10^{-6}$ mol per mol of silver halide, of tellurium compound (II-10) was added to the aqueous sodium chloride solution to be added last (or in the third step) in forming the grains.

In addition to the sensitizing dye (a), compound (f) was added to each of emulsions (M-1) to (M-4) and (N-1) to (N-4), in the manner as indicated below.

Precisely, the following color sensitizing dye (a) was added to the red-sensitive emulsion layer, in an amount of $0.9\times10^{-4}$ mol per mol of silver halide, to the large-size emulsion and in an amount of $1.1\times10^{-4}$ mol per mol of silver halide, to the small-size emulsion.

Sensitizing Dye (a):

-continued

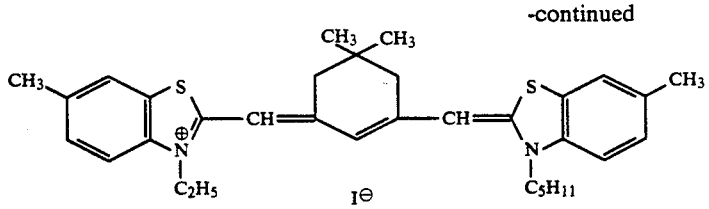

In addition to this, the following compound (f) was added thereto in an amount of $2.6\times10^{-3}$ mol per mol of silver halide.

(f):

By combining the resulting twenty-four kinds of silver halide emulsions, multi-layer color photographic material samples (3-1) to (3-4) as indicated in Table 5 below were prepared. Preparation of the coating liquids for the samples were effected in the same manner as in Example 1. Table 5 below shows the combination of the silver halide emulsions, the layer constitution and the amounts of compounds in each sample.

TABLE 5

| Layer | Components | Sample (3-1) | Sample (3-2) | Sample (3-3) | Sample (3-4) |
|---|---|---|---|---|---|
| Support | polyethylene-laminated paper (containing $TiO_2$ and ultramarine in polyethylene below 1st layer) | | | | |
| 1st layer (blue-sensitive emulsion layer) | silver halide emulsion | I-1/J-1 | I-2/J-2 | I-3/J-3 | I-4/J-4 |
| | amount of Ag coated | 0.09/0.21 | 0.09/0.21 | 0.09/0.21 | 0.09/0.21 |
| | gelatin | 1.22 | 1.22 | 1.22 | 1.22 |
| | yellow coupler (ExY) | 0.82 | 0.82 | 0.82 | 0.82 |
| | color image stabilizer (Cpd-1) | 0.19 | 0.19 | 0.19 | 0.19 |
| | color image stabilizer (Cpd-7) | 0.06 | 0.06 | 0.06 | 0.06 |
| | solvent (Solv-3) | 0.18 | 0.18 | 0.18 | 0.18 |
| | solvent (Solv-7) | 0.18 | 0.18 | 0.18 | 0.18 |
| 2nd layer (color mixing preventing layer) | gelatin | 0.64 | 0.64 | 0.64 | 0.64 |
| | color mixing preventing agent (Cpd-5) | 0.10 | 0.10 | 0.10 | 0.10 |
| | solvent (Solv-1) | 0.16 | 0.16 | 0.16 | 0.16 |
| | solvent (Solv-4) | 0.08 | 0.08 | 0.08 | 0.08 |
| 3rd layer (green-sensitive emulsion layer) | silver halide emulsion | K-1/L-1 | K-2/L-2 | K-3/L-3 | K-4/L-4 |
| | amount of Ag coated | 0.04/0.08 | 0.04/0.08 | 0.04/0.08 | 0.04/0.08 |
| | gelatin | 1.28 | 1.28 | 1.28 | 1.28 |
| | magenta coupler (ExM) | 0.23 | 0.23 | 0.23 | 0.23 |
| | color image stabilizer (Cpd-2) | 0.03 | 0.03 | 0.03 | 0.03 |
| | color image stabilizer (Cpd-3) | 0.16 | 0.16 | 0.16 | 0.16 |
| | color image stabilizer (Cpd-4) | 0.02 | 0.02 | 0.02 | 0.02 |
| | color image stabilizer (Cpd-9) | 0.02 | 0.02 | 0.02 | 0.02 |
| | solvent (Solv-2) | 0.40 | 0.40 | 0.40 | 0.40 |
| 4th layer (ultraviolet absorbing layer) | gelatin | 1.41 | 1.41 | 1.41 | 1.41 |
| | ultraviolet absorbent (UV-1) | 0.47 | 0.47 | 0.47 | 0.47 |
| | color mixing preventing agent (Cpd-5) | 0.05 | 0.05 | 0.05 | 0.05 |
| | solvent (Solv-5) | 0.24 | 0.24 | 0.24 | 0.24 |
| 5th layer (red-sensitive emulsion layer) | silver halide emulsion | M-1/N-1 | M-2/N-2 | M-3/N-3 | M-4/N-4 |
| | amount of Ag coated | 0.10/0.13 | 0.10/0.13 | 0.10/0.13 | 0.10/0.13 |
| | gelatin | 1.04 | 1.04 | 1.04 | 1.04 |
| | cyan coupler (ExC) | 0.32 | 0.32 | 0.32 | 0.32 |
| | color image stabilizer (Cpd-2) | 0.03 | 0.03 | 0.03 | 0.03 |
| | color image stabilizer (Cpd-4) | 0.02 | 0.02 | 0.02 | 0.02 |
| | color image stabilizer (Cpd-4) | 0.18 | 0.18 | 0.18 | 0.18 |
| | color image stabilizer (Cpd-7) | 0.40 | 0.40 | 0.40 | 0.40 |
| | color image stabilizer (Cpd-8) | 0.05 | 0.05 | 0.05 | 0.05 |
| | solvent (Solv-6) | 0.14 | 0.14 | 0.14 | 0.14 |
| sixth layer (ultraviolet absorbing layer) | gelatin | 0.48 | 0.48 | 0.48 | 0.48 |
| | ultraviolet absorbent (UV-1) | 0.16 | 0.16 | 0.16 | 0.16 |
| | color mixing preventing agent (Cpd-5) | 0.02 | 0.02 | 0.02 | 0.02 |
| | solvent (Solv-5) | 0.08 | 0.08 | 0.08 | 0.08 |
| 7th layer (protective layer) | gelatin | 1.10 | 1.10 | 1.10 | 1.10 |
| | acryl-modified polymer of polyvinyl alcohol (modification degree 17%) | 0.17 | 0.17 | 0.17 | 0.17 |
| | liquid paraffin | 0.03 | 0.03 | 0.03 | 0.03 |

The numerals each indicate the amount of the component coated, as a unit of $g/m^2$.

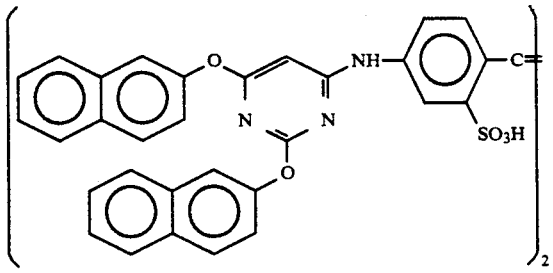

1-(5-Methylureidophenyl)-5-mercaptotetrazole was added to each silver halide emulsion layer above in an amount of $5.0\times10^{-4}$ mol per mol of silver halide, for the purpose of anti-fogging and stabilization.

1-Hydroxy-3,5-dichloro-s-triazine sodium salt was added in an amount of 1.4% by weight based on a total gelatin in the photographic material to each layer as a gelatin hardening agent.

For anti-irradiation, the following compounds were added to each sample.

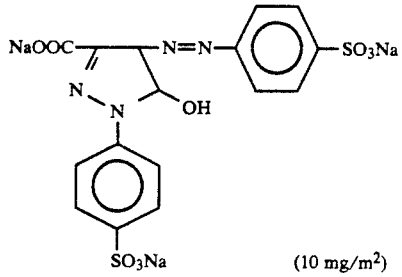

(10 mg/m²)

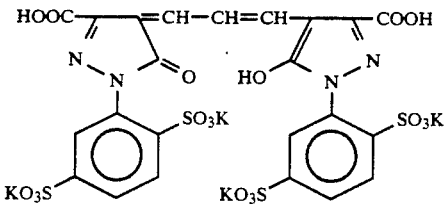

(10 mg/m²)

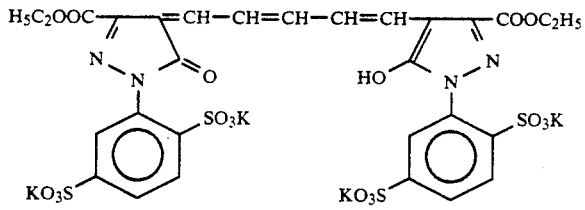

(40 mg/m²)

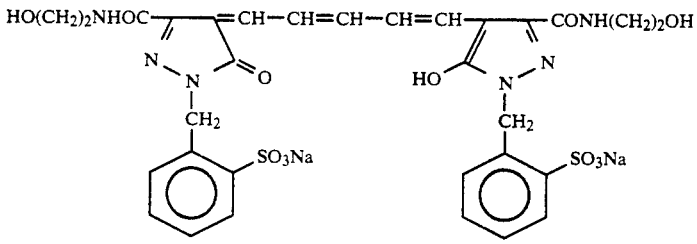

(20 mg/m²

As antiseptics, the following compounds (Cpd-10) and (Cpd-11) were added to each sample, in an amount of 50 mg/m² and 30 mg/m², respectively.

The photographic properties of these color photographic material samples were tested in the manner mentioned below.

First, each sample was subjected to exposure of 0.1 second and 250 CMS with the same sensitometer as that used in Example 1 at room temperature (24° C.) through an optical wedge and blue, green and red filters. The exposed samples were then color-developed with a paper processing machine in accordance with the process mentioned below, using the processing solutions also mentioned below.

Process for Color Development:

| Step | Temperature | Time | Amount of Replenisher (*) | Tank Capacity |
|---|---|---|---|---|
| color development | 35° C. | 45 sec | 161 ml | 17 liters |
| bleach-fixation | 30 to 35° C. | 45 sec | 215 ml | 17 liters |
| Rinsing (1) | 30 to 35° C. | 20 sec | — | 10 liters |
| Rinsing (2) | 30 to 35° C. | 20 sec | — | 10 liters |
| Rinsing (3) | 30 to 35° C. | 20 sec | 350 ml | 10 liters |
| Drying | 70 to 80° C. | 60 sec | | |

The amount of each replenisher is per m² of the sample being processed.

Rinsing was effected by a 3-tank countercurrent system from rinsing tank (3) to rinsing tank (1).

The compositions of the processing solutions used above are mentioned below.

| Color Developer | Tank Solution | Replenisher |
|---|---|---|

-continued

| | | |
|---|---|---|
| Water | 800 ml | 800 ml |
| Ethylenediamine-N,N,N,N-tetra-methylenephosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-ethyl-N-(β-methanesulfonamido-ethyl)-3-methyl-4-aminoaniline Sulfate | 5.0 g | 7.0 g |
| N,N-bis(carboxymethyl)hydrazine | 4.0 g | 5.0 g |
| N,N-di(sulfoethyl)hydroxylamine Monosodium Salt | 4.0 g | 5.0 g |
| Brightening Agent (WHITEX 4B, produced by Sumitomo Chemical Co.) | 1.0 g | 2.0 g |
| Water to make | 1000 ml | 1000 ml |
| pH (25° C.) | 10.05 | 10.45 |

| Bleach-fixing Solution | (for both tank solution and replenisher): |
|---|---|
| Water | 400 ml |
| Ammonium Thiosulfate (700 g/liter) | 100 ml |
| Sodium Sulfite | 17 g |
| Ammonium Ethylenediaminetetraacetato/Iron(III) | 55 g |
| Disodium Ethylenediaminetetraacetate | 5 g |
| Ammonium Bromide | 40 g |
| Water to make | 1000 ml |
| pH (25° C.) | 6.0 |

| Rinsing Solution (for both tank solution and replenisher): |
|---|
| Ion-exchanged water (having calcium content and magnesium content of each 3 ppm or less). |

The reflection density of each of the resulting processed samples was measured in order to obtain a characteristic curve, from which the sensitivity of each of the blue-sensitive layer, green-sensitive layer and red-sensitive layer (B, G, R) was obtained. The sensitivity was obtained in the same manner as in Example 1 and was represented by a value relative to the sensitivity of each of B, G and R of sample (3-1) as being 100.

Next, the following test was carried out for the purpose of examining how the sensitivity of each sample might fluctuate under variations in the ambient temperature during exposure.

Specifically, a color negative film (Fuji Color HG100), which had previously been exposed to have a standard scene along with a gray patch having a density of 0.8 under a standard exposure level and had been developed, was prepared. From this, each sample was printed with an automatic printer (FAP 3500 Model, manufactured by Fuji Photo Film Co.) in accordance with the process mentioned below. Color development of each sample was effected immediately after printing, under the same conditions as for sensitometry.

1. The printer was started in the morning with a room temperature of 12° C., while at the same time the air conditioner in the room was started so that the room temperature might settle to a temperature of 22° C. The printing condition was adjusted, using sample (3-1), and 25 frames were continuously printed with the sample. During the continuous printing, the temperature of the area of the sample to be exposed was measured to be 14.1° C.

2. Next, in order to maintain the continuous running condition of the printer, printing was continued for 1.5 hours, using commercial color photographic papers.

3. Afterwards, sample (3-1) was again set, in place of the commercial color photographic papers, in the same printer to effect continuous printing of 25 frames under the conditions as stated in step 1 above. During the continuous printing, the temperature of the area in which the sample was exposed was measured and it had elevated to 27.9° C.

4. Next, commercial color photographic papers were again set, in place of sample (3-1), in the same printer in order to continuously operate it for printing for 2 hours.

5. Afterwards, sample (3-1) was once again set, in place of the commercial color photographic papers, in the same printer to further effect continuous printing of 25 frames under the conditions as stated in step 1 above. During the continuous printing, the temperature of the area in which the sample was exposed was measured and it had elevated further to 32.5° C.

6. With respect to the above-mentioned three printing tests, the color density of the gray patch in the printed image plane of each print frame was measured, and the mean value of the 25 frames printed was calculated.

The same test was applied to samples (3-2), (3-3) and (3-4), and the results obtained are shown in Table 6 below. In these experiments, the exposure temperature in the first to third exposure tests was suitably adjusted such that it would fall within a negligible error range in every experiment.

TABLE 6

| Sample | Sensitivity | Print Density in Continuous Printing (temperature of exposed area) 1st printing | 2nd printing | 3rd printing | Remarks |
|---|---|---|---|---|---|
| 3-1 | B 100 | Y 0.76 | 0.79 | 0.85 | comparative sample |
| | G 100 | M 0.81 (14.1° C.) | 0.86 (27.9° C.) | 0.92 (32.5° C.) | |
| | R 100 | C 0.83 | 0.91 | 0.97 | |
| 3-2 | B 104 | Y 0.77 | 0.80 | 0.85 | comparative sample |
| | G 105 | M 0.80 (14.5° C.) | 0.85 (28.6° C.) | 0.90 (33.3° C.) | |
| | R 109 | C 0.83 | 0.89 | 0.95 | |
| 3-3 | B 315 | Y 0.78 | 0.81 | 0.84 | comparative sample |
| | G 321 | M 0.83 (14.9° C.) | 0.86 (29.2° C.) | 0.90 (34.3° C.) | |
| | R 329 | C 0.85 | 0.89 | 0.94 | |
| 3-4 | B 352 | Y 0.76 | 0.77 | 0.78 | sample of the invention |
| | G 364 | M 0.81 (13.9° C.) | 0.82 (27.6° C.) | 0.83 (32.8° C.) | |
| | R 392 | C 0.84 | 0.85 | 0.87 | |

As is obvious from the results in Table 6 above, color photographic material sample (3-4) of the present invention, which had the emulsions of silver halide grains containing the iron compound and the tellurium compound therein in accordance with the present invention, had a high sensitivity. It is also understood therefrom that the fluctuation of the photographic property of sample (3-4) of the present invention, due to variations in the temperature of the exposed area which is caused by the continuous running of the printer (judged by the variation of the density of the gray patch in each print), was more noticeably inhibited than the other comparative samples (3-1) to (3-3).

In place of the tellurium compound (II-10), one of other tellurium compounds (II-12), (II-15) and (III-1) was used in carrying out the same test, where the same result as above was obtained in every case.

Compounds used in preparing the photographic material samples above are mentioned below.

(ExY) Yellow Coupler:

1/1 mixture (by mol) of the following compounds:

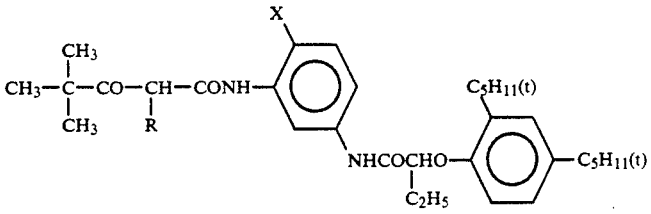

where

R = 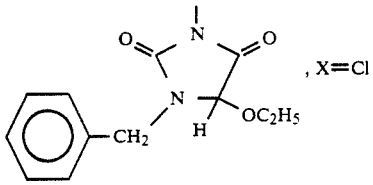 , X=Cl and

R = 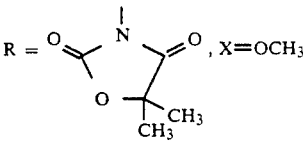 , X=OCH$_3$ (ExM) Magenta Coupler:

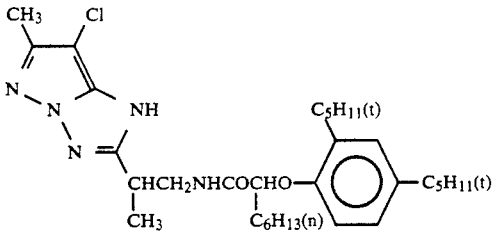

(ExC) Cyan Coupler: 1/1 mixture (by mol) of the following compounds:

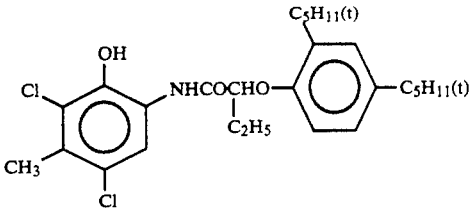

and

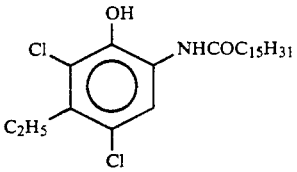

(Cpd-1) Color Image Stabilizer:

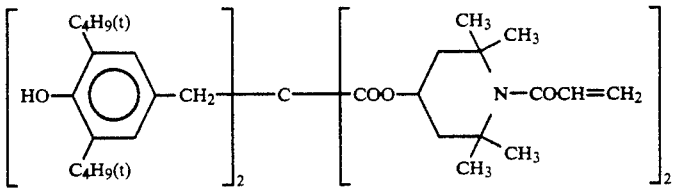

(Cpd-2) Color Image Stabilizer:

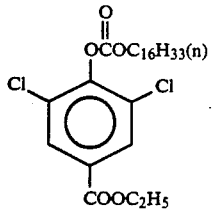

(Cpd-3) Color Image Stabilizer:

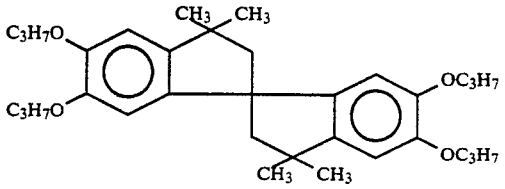

(Cpd-4) Color Image Stabilizer:

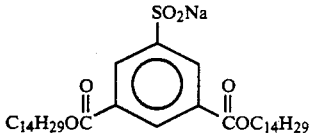

(Cpd-5) Color Image Stabilizer:

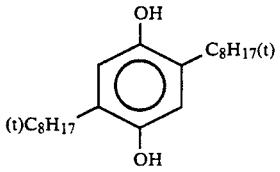

(Cpd-6) Color Image Stabilizer:
2/4/4 mixture (by weight) of the following compounds:

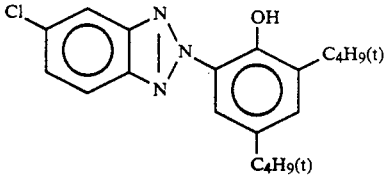

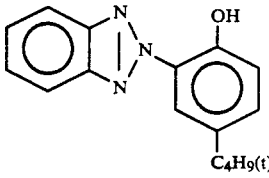

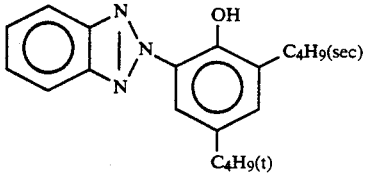

(Cpd-7) Color Image Stabilizer:

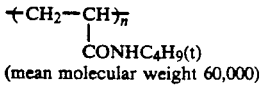

(mean molecular weight 60,000)

(Cpd-8) Color Image Stabilizer:
1/1 mixture (by weight) of the following compounds:

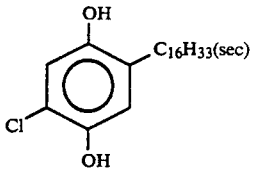

and

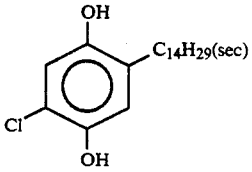

(Cpd-9) Color Image Stabilizer:

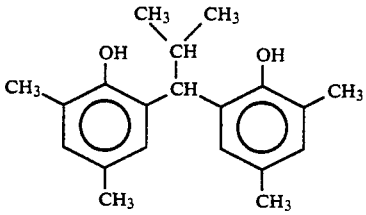

(Cpd-10) Antiseptic:

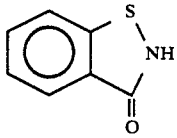

(Cpd-11) Antiseptic:

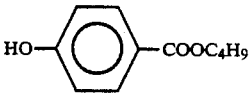

(UV-1) Ultraviolet Absorbent:
4/2/4 mixture (by weight) of the following compounds:

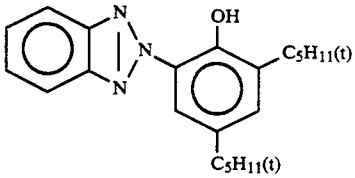

-continued

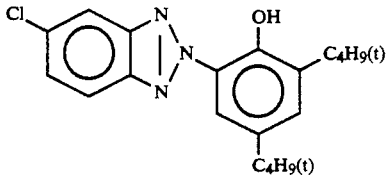

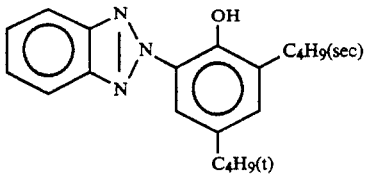

(Solv-1) Solvent:

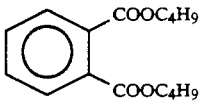

(Solv-2) Solvent:

1/1 mixture (by volume) of the following compounds:

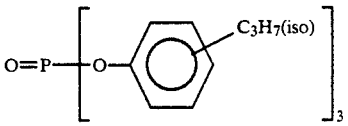

and

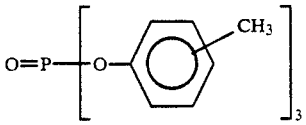

(Solv-3) Solvent:

$O{=}P{+}O{-}C_9H_{19}(iso)]_3$ (Solv-4) Solvent:

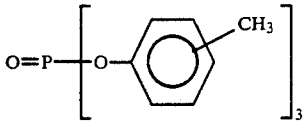

(Solv-5) Solvent:

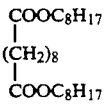

(Solv-6) Solvent:

80/20 mixture (by volume) of the following compounds:

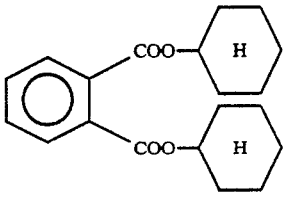

and

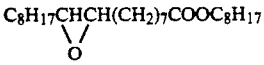

(Solv-7) Solvent:

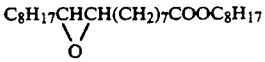

EXAMPLE 4

Emulsion (O-1) was prepared in the same manner as the silver halide emulsion (B-1) in Example 1, except for the following points. Specifically, the temperature during formation of the emulsion grains was varied to 56° C. and the time of addition for the aqueous silver nitrate solution and the aqueous sodium chloride solution was varied in order to obtain an emulsion comprising cubic silver halide grains having a mean grain size of 0.53 μ and a fluctuation coefficient of grain size distribution of 8%. 16.0 μg of rhodium trichloride trihydrate was added to the aqueous sodium chloride solution to be added in the second step in forming the grains. In place of the color sensitizing dye (a), color sensitizing dyes (F) and (G) mentioned below were each added in an amount of $1.0\times10^{-4}$ mol per mol of silver halide, and the amount of the sulfur sensitizer of triethylthiourea was suitably adjusted to effect the optimum chemical sensitization, along with gold sensitization with chloroauric acid.

(F)

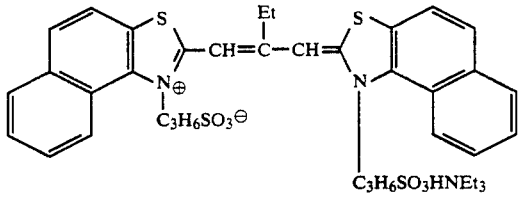

(G)

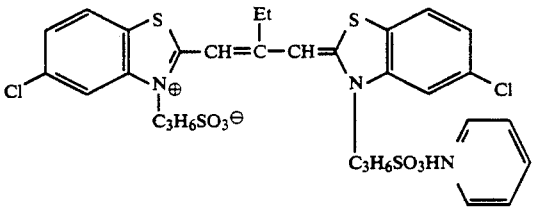

(each $1.0\times10^{-4}$ mol per mol of silver halide)

Emulsion (P-1) was prepared in the same manner as emulsion (O-1), except that $4.5\times10^{-5}$ mol per mol of silver halide, of the following compound (H) was added in place of the color sensitizing dyes (F) and (G) and that the amount of the sulfur sensitizer of triethylthiourea and that of the gold sensitizer of chloroauric acid were suitably adjusted to effect the optimum chemical sensitization.

Emulsion (Q-1) was prepared in the same manner as emulsion (O-1), except that $5.0\times10^{-6}$ mol per mol of silver halide, of the following compound (I) was added in place of the color sensitizing dyes (F) and (G) and that the amount of the sulfur sensitizer of triethylthiourea and that of the gold sensitizer of chloroauric acid were suitably adjusted to effect the optimum chemical sensitization.

(H):

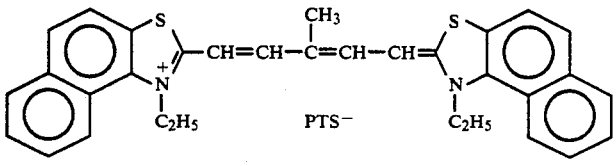

($4.5\times10^{-5}$ mol per mol of silver halide)

(I):

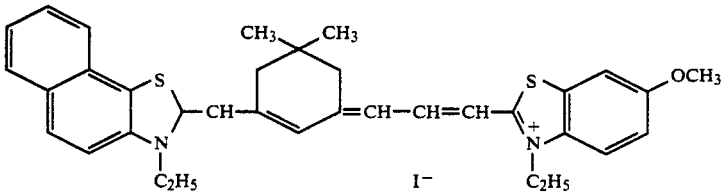

($0.5\times10^{-5}$ mol per mol of silver halide)

Emulsion (O-2) was prepared in the same manner as emulsion (O-1), except that $1.1\times10^{-6}$ mol per mol of silver halide, of tellurium compound (II-10) was added to the aqueous sodium chloride solution to be added last (or in the third step) during formation of the grains.

Emulsion (P-2) was prepared in the same manner as emulsion (P-1), except that $1.1\times10^{-6}$ mol per mol of silver halide, of tellurium compound (II-10) was added to the aqueous sodium chloride solution to be added last (or in the third step) during formation of the grains.

Emulsion (Q-2) was prepared in the same manner as emulsion (Q-1), except that $1.1\times10^{-6}$ mol per mol of silver halide, of tellurium compound (II-10) was added to the aqueous sodium chloride solution to be added last (or in the third step) during formation of the grains.

Next, emulsion (O-3) was prepared in the same manner as the silver halide emulsion (D-1) of Example 1, except for the following points. Specifically, the temperature during formation of the emulsion grains was varied to 56° C. and the time of addition for the aqueous silver nitrate solution and the aqueous sodium chloride solution was varied in order to obtain an emulsion comprising cubic silver halide grains having a mean grain size of 0.53 $\mu$ and a fluctuation coefficient of grain size distribution of 8%. 16.0 $\mu$g of rhodium trichloride trihydrate was added to the aqueous sodium chloride solution added in the second step in forming the grains. In place of the color sensitizing dye (a), the color sensitizing dyes (F) and (G) mentioned above were each added in an amount of $1.0\times10^{-4}$ mol per mol of silver halide, and the amount of the sulfur sensitizer of triethylthiourea was suitably adjusted to effect the optimum chemical sensitization, along with gold sensitization with chloroauric acid.

Emulsion (P-3) was prepared in the same manner as emulsion (O-3), except that $4.5\times10^{-6}$ mol per mol of silver halide, of the above-mentioned compound (H) was added in place of the color sensitizing dyes (F) and (G), and that the amount of the sulfur sensitizer of triethylthiourea and that of the gold sensitizer of chloroauric acid were suitably adjusted to effect the optimum chemical sensitization.

Emulsion (Q-3) was prepared in the same manner as emulsion (O-3), except that $5.0\times10^{-6}$ mol per mol of silver halide, of the above-mentioned compound (I) was added in place of the color sensitizing dyes (F) and (G), and that the amount of the sulfur sensitizer of triethylthiourea and that of the gold sensitizer of chloroauric acid were suitably adjusted to effect the optimum chemical sensitization.

Emulsion (O-4) was prepared in the same manner as emulsion (O-3), except that $1.1\times10^{-6}$ mol per mol of silver halide, of the previously mentioned tellurium compound (II-10) was added to the aqueous sodium chloride solution to be added last (or in the third step) in forming the grains.

Emulsion (P-4) was prepared in the same manner as emulsion (P-3), except that $1.1\times10^{-6}$ mol per mol of silver halide, of the previously mentioned tellurium compound (II-10) was added to the aqueous sodium chloride solution to be added last (or in the third step) in forming the grains.

Emulsion (Q-4) was prepared in the same manner as emulsion (Q-3), except that $1.1\times10^{-6}$ mol per mol of silver halide, of the previously mentioned tellurium compound (II-10) was added to the aqueous sodium chloride solution to be added last (or in the third step) in forming the grains.

By combining the thus resulting twelve kinds of silver halide emulsion samples, infrared-sensitized multilayer color photographic material samples (4-1) to (4-4) were prepared. Coating compositions for their formation were prepared in the same manner as in Example 1. The combination of the silver halide emulsions used, the layer constitution of each sample, and the amount of each constitutive component are shown in Table 7 below.

Each emulsion layer contained the following compounds J, K and L, in an amount of $2\times10^{-4}$ mol, $3\times10^{-4}$ mol and $5\times10^{-4}$ mol per mol of silver halide, respectively.

TABLE 7

| Layer | Components | Sample (4-1) | Sample (4-2) | Sample (4-3) | Sample (4-4) |
|---|---|---|---|---|---|
| Support | polyethylene-laminated paper (containing $TiO_2$ and bluish dry (ultramarine) in polyethylene below 1st layer) | | | | |
| 1st layer (blue-sensitive emulsion layer) | silver halide emulsion | O-1 | O-2 | O-3 | O-4 |
| | amount of Ag coated | 0.30 | 0.30 | 0.30 | 0.30 |
| | gelatin | 1.22 | 1.22 | 1.22 | 1.22 |
| | yellow coupler (ExY) | 0.82 | 0.82 | 0.82 | 0.82 |
| | color image stabilizer (Cpd-1) | 0.19 | 0.19 | 0.19 | 0.19 |
| | color image stabilizer (Cpd-7) | 0.06 | 0.06 | 0.06 | 0.06 |
| | solvent (Solv-3) | 0.18 | 0.18 | 0.18 | 0.18 |
| | solvent (Solv-7) | 0.18 | 0.18 | 0.18 | 0.18 |
| 2nd layer (color mixing preventing layer) | gelatin | 0.64 | 0.64 | 0.64 | 0.64 |
| | color mixing preventing agent (Cpd-5) | 0.10 | 0.10 | 0.08 | 0.08 |
| | solvent (Solv-1) | 0.16 | 0.16 | 0.16 | 0.16 |
| | solvent (Solv-4) | 0.08 | 0.08 | 0.08 | 0.08 |
| 3rd layer (infrared-sensitive magenta-coloring layer) | silver halide emulsion | P-1 | P-2 | P-3 | P-4 |
| | amount of Ag coated | 0.12 | 0.12 | 0.12 | 0.12 |
| | gelatin | 1.28 | 1.28 | 1.28 | 1.28 |
| | magenta coupler (ExM) | 0.23 | 0.23 | 0.23 | 0.23 |
| | color image stabilizer (Cpd-2) | 0.03 | 0.03 | 0.03 | 0.03 |
| | color image stabilizer (Cpd-3) | 0.16 | 0.16 | 0.16 | 0.16 |
| | color image stabilizer (Cpd-4) | 0.02 | 0.02 | 0.02 | 0.02 |
| | color image stabilizer (Cpd-9) | 0.02 | 0.02 | 0.02 | 0.02 |
| | solvent (Solv-2) | 0.40 | 0.40 | 0.40 | 0.40 |
| 4th layer (ultraviolet absorbing layer) | gelatin | 1.41 | 1.41 | 1.41 | 1.41 |
| | ultraviolet absorbent (UV-1) | 0.47 | 0.47 | 0.47 | 0.47 |
| | color mixing preventing agent (Cpd-5) | 0.05 | 0.05 | 0.05 | 0.05 |
| | solvent (Solv-5) | 0.24 | 0.24 | 0.24 | 0.24 |
| 5th layer (infrared-sensitive cyan coloring layer) | silver halide emulsion | Q-1 | Q-2 | Q-3 | Q-4 |
| | amount of Ag coated | 0.23 | 0.23 | 0.23 | 0.23 |
| | gelatin | 1.04 | 1.04 | 1.04 | 1.04 |
| | cyan coupler (ExC) | 0.32 | 0.32 | 0.32 | 0.32 |
| | color image stabilizer (Cpd-2) | 0.03 | 0.03 | 0.03 | 0.03 |
| | color image stabilizer (Cpd-4) | 0.02 | 0.02 | 0.02 | 0.02 |
| | color image stabilizer (Cpd-4) | 0.18 | 0.18 | 0.18 | 0.18 |
| | color image stabilizer (Cpd-7) | 0.40 | 0.40 | 0.40 | 0.40 |
| | color image stabilizer (Cpd-8) | 0.05 | 0.05 | 0.05 | 0.05 |
| | solvent (Solv-6) | 0.14 | 0.14 | 0.14 | 0.14 |
| sixth layer (ultraviolet absorbing layer) | gelatin | 0.48 | 0.48 | 0.48 | 0.48 |
| | ultraviolet absorbent (UV-1) | 0.16 | 0.16 | 0.16 | 0.16 |
| | color mixing preventing agent (Cpd-5) | 0.02 | 0.02 | 0.02 | 0.02 |
| | solvent (Solv-5) | 0.08 | 0.08 | 0.08 | 0.08 |
| 7th layer (protective layer) | gelatin | 1.10 | 1.10 | 1.10 | 1.10 |
| | acryl-modified polymer of polyvinyl alcohol (modification degree 17%) | 0.17 | 0.17 | 0.17 | 0.17 |
| | liquid paraffin | 0.03 | 0.03 | 0.03 | 0.03 |

The numerals each indicate the amount of the component coated, as a unit of $g/m^2$.

Compound J:
1/1 mixture (by mol) of the following components:

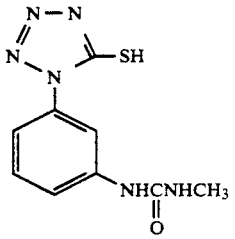

and

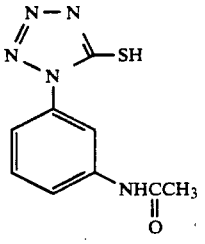

Compound K:

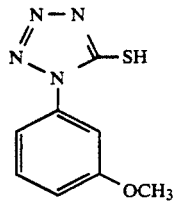

Compound L:

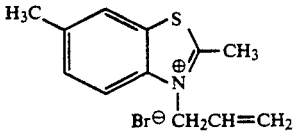

The following water-soluble dyes were added to each sample for the purpose of improving the irradiation resistance and the safelight safety thereof.

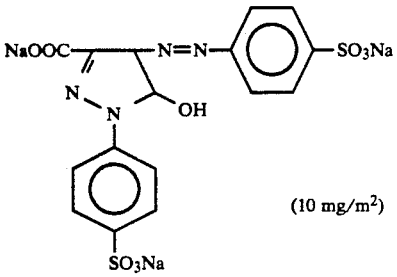
(10 mg/m$^2$)
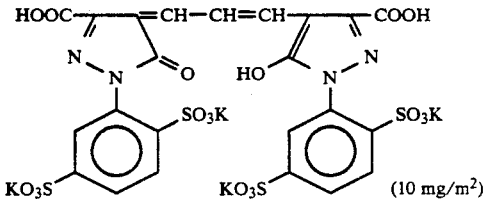
(10 mg/m$^2$)
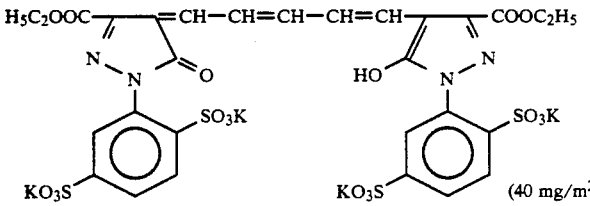
(40 mg/m$^2$)
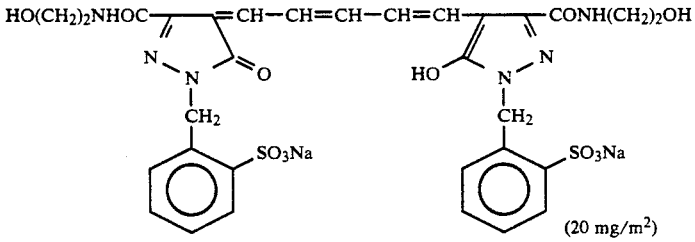
(20 mg/m$^2$)
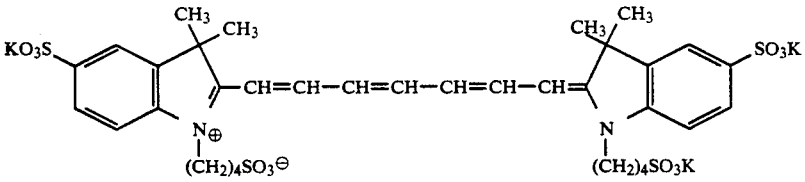
(10 mg/m$^2$)
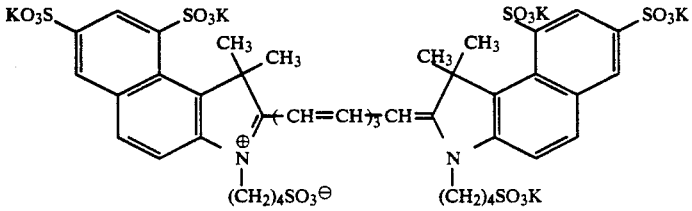
(5 mg/m$^2$)

-continued

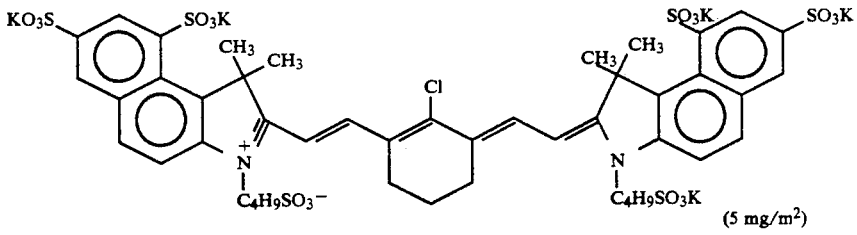

The same gelatin hardening agent and antiseptics as those used in Example 3 were added to each layer.

The photographic properties of each of the resulting four kinds of infrared-sensitive multi-layer color photographic material samples were tested in the manner set forth below.

A scanning exposure device was constructed, in which laser rays from three semiconductor lasers of AlGaInP (oscillation wavelength: about 670 nm), GaAlAs (oscillation wavelength: about 750 nm) and GaAlAs (oscillation wavelength: about 830 nm) were scanned by reflection from the mirror surface of a rotary polyhedron and a photographic material sample moving in a vertical direction to the scanning direction was thus exposed to the laser rays. The exposure amount from the laser beams was electrically controlled by varying the emitting time of the laser rays and the emitted amount therefrom. The mean exposure time per pixel was about $10^{-7}$ second.

As image information, the same exposure as an ordinary sensitometry was applied to each sample in such a way that the optical wedge-like variation of the exposure amount might be imparted to the surface of the sample being exposed by controlling the respective laser rays as applied thereto, in a room having a room temperature of 24° C., whereupon the property of each light-sensitive emulsion layer of the tested sample to each exposure wavelength was examined.

Samples (4-1) to (4-4) each contained silver halide emulsions combined such that the yellow-coloring layer was sensitive to the laser ray of 670 nm, the magenta-coloring layer was sensitive to the laser ray of 750 nm, and the cyan-coloring layer was sensitive to the laser ray of 830 nm.

For the purpose of examining fluctuation of the photographic property of each sample, if any, due to variation in the ambient temperature during exposure, the temperature of the room having the exposing means was changed to 15° C. and to 35° C., whereupon the fluctuation, if any, of the sensitivity of each tested sample was obtained.

In every experiment, the exposed samples were color-developed in accordance with the process mentioned below, using the processing solutions also mentioned below. The results obtained are shown in Table 8 below.

| Process for Color Development: | | | | |
|---|---|---|---|---|
| Step | Temperature | Time | Amount of Replenisher (*) | Tank Capacity |
| color development | 35° C. | 20 sec | 60 ml | 2 liters |
| bleach-fixation | 30 to 35° C. | 20 sec | 60 ml | 2 liters |
| Rinsing (1) | 30 to 35° C. | 10 sec | — | 1 liter |
| Rinsing (2) | 30 to 35° C. | 10 sec | — | 1 liter |
| Rinsing (3) | 30 to 35° C. | 10 sec | 120 ml | 1 liter |

-continued

| Process for Color Development: | | | | |
|---|---|---|---|---|
| Step | Temperature | Time | Amount of Replenisher (*) | Tank Capacity |
| Drying | 70 to 80° C. | 20 sec | | |

The amount of each replenisher is per $m^2$ of the sample being processed.

Rinsing was effected by a 3-tank countercurrent system from rinsing tank (3) to rinsing tank (1).

The compositions of the processing solutions used above are mentioned below.

| Color Developer | Tank Solution | Replenisher |
|---|---|---|
| Water | 800 ml | 800 ml |
| Ethylenediamine-N,N,N,N-tetramethylenephosphonic Acid | 1.5 g | 2.0 g |
| Potassium Bromide | 0.015 g | — |
| Triethanolamine | 8.0 g | 12.0 g |
| Sodium Chloride | 4.9 g | — |
| Potassium Carbonate | 25 g | 37 g |
| 4-amino-3-methyl-N-ethyl-N-(3-hydroxypropyl)aniline-2-p-toluenesulfonic Acid | 12.8 g | 19.8 g |
| N,N-bis(carboxymethyl)hydrazine | 5.5 g | 7.0 g |
| Brightening Agent (WHITEX 4B, produced by Sumitomo Chemical Co.) | 1.0 g | 2.0 g |
| Water to make | 1000 ml | 1000 ml |
| pH (25° C.) | 10.05 | 10.45 |

| Bleach-fixing Solution | (for both tank solution and replenisher) |
|---|---|
| Water | 400 ml |
| Ammonium Thiosulfate (700 g/liter) | 100 ml |
| Sodium Sulfite | 17 g |
| Ammonium Ethylenediaminetetraacetato/Iron(III) | 55 g |
| Disodium Ethylenediaminetetraacetate | 5 g |
| Ammonium Bromide | 40 g |
| Water to make | 1000 ml |
| pH (25° C.) | 6.0 |

| Rinsing Solution (for both tank solution and replenisher): |
|---|
| Ion-exchanged water (having calcium content and magnesium content of each 3 ppm or less). |

TABLE 8

| Sample | Sensitivity 24° C. exposure | Difference in sensitivity between 15° C. exposure and 35° C. exposure Difference in exposure amount (log E) to give density of 1.0 | Remarks |
|---|---|---|---|
| 4-1 | Y 100 | 0.09 | comparative |
| | M 100 | 0.22 | sample |
| | C 100 | 0.28 | |
| 4-2 | Y 115 | 0.08 | comparative |
| | M 116 | 0.19 | sample |
| | C 120 | 0.25 | |
| 4-3 | Y 411 | 0.05 | comparative |

TABLE 8-continued

| Sample | Sensitivity 24° C. exposure | Difference in sensitivity between 15° C. exposure and 35° C. exposure Difference in exposure amount (log E) to give density of 1.0 | Remarks |
|---|---|---|---|
| | M 413 | 0.17 | sample |
| | C 424 | 0.20 | |
| 4-4 | Y 529 | 0.04 | sample of the |
| | M 547 | 0.06 | invention |
| | C 592 | 0.06 | |

The sensitivity indicates a reciprocal of the exposure amount which gives a density of 1.0 and is represented by a value relative to the sensitivity value of sample (4-1) as being 100. The sensitivity fluctuation due to variations in the ambient temperature during exposure is represented by the difference in the exposure amount which gives a density of 1.0, as log E.

From the results in Table 8 above, it is clear that the effect of the present invention, which elevates the sensitivity, due to the use of emulsions with silver halide grains containing an iron compound and a tellurium compound, and additionally reduces the fluctuation of the sensitivity when variations in the ambient temperature occur during exposure, which is especially important during the exposure of an infrared-sensitive photographic material with laser rays.

As is obvious from the results obtained in the examples mentioned above, the present invention provides a high-sensitivity and high-contrast emulsion with excellent rapid processability as well as a photographic material containing such an emulsion. In addition, the photographic properties of the photographic material having the emulsion of the present invention, especially the sensitivity thereof, hardly fluctuate when variations in the ambient temperature occur during exposure of the material.

The effect of the present invention is especially important in a silver halide photographic material for high-intensity exposure and in an infrared-sensitized silver halide photographic material for laser exposure.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having at least one light-sensitive emulsion layer on a support, wherein at least one of said light-sensitive emulsion layers has an emulsion containing silver halide grains composed of silver chlorobromide, silver chloroiodide, or silver chloroiodobromide each having a silver chloride content of at least 90 mol %, or silver chloride, and the silver halide grains contain, before completion of physical ripening of the grains, an iron compound in an amount of from $10^{-7}$ to $10^{-3}$ mol per mol of silver halide, and a tellurium compound in an amount of from $10^{-7}$ to $10^{-4}$ mol per mol of silver halide.

2. The silver halide photographic material of claim 1, wherein the iron compound to be in the silver halide grains is a divalent or trivalent iron complex compound as coordinated with 5 or 6 cyan ligands.

3. The silver halide photographic material of claim 2, wherein the iron compound is selected from the group consisting ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ammonium ferrous nitrate, basic ferric acetate, ferric albuminate, ammonium ferric acetate, ferric bromide, ferric chloride, ferric chromate, ferric citrate, ferric fluoride, ferric formate, ferric glycerophosphate, ferric hydroxide, acidic ferric phosphate, ferric nitrate, ferric phosphate, ferric pyrophosphate, sodium ferric pyrophosphate, ferric thiocyanate, ferric sulfate, ammonium ferric sulfate, guanidinium ferric sulfate, ammonium ferric citrate, potassium hexacyanoferrate(II), potassium pentacyanoamine ferrate(II), sodium ethylenedinitrilotetraacetatoferrate(III), potassium hexacyanoferrate(III), tris(bipyridyl) chloride/Fe(III), and potassium pentacyanonitrosyl ferrate(III).

4. The silver halide photographic material of claim 1, wherein the tellurium compound to be in the silver halide grains is selected from the group consisting of telluroureas, isotellurocyanates, telluroketones, telluroamides, tellurohydrazides, telluroesters, phosphine tellurides, and negative-charged telluride ion-containing gelatins, potassium telluride, potassium tellurocyanate, telluropentathionate sodium salt, and allyltellurocyanate.

5. The silver halide photographic material of claim 4, wherein the tellurium compound is represented by the following formula (II) or (III):

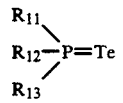

(II)

wherein $R_{11}$, $R_{12}$ and $R_{13}$ independently represent an aliphatic group, an aromatic group, a heterocyclic group, $OR_{14}$, $NR_{15}(R_{16})$, $SR_{17}$, $OSiR_{18}(R_{19})(R_{20})$, X, or a hydrogen atom; $R_{14}$ and $R_{17}$ independently represent an aliphatic group, an aromatic group, a heterocyclic group, a hydrogen atom or a cation; $R_{15}$ and $R_{16}$ independently represent an aliphatic group, an aromatic group, a heterocyclic group or a hydrogen atom; $R_{18}$, $R_{19}$ and $R_{20}$ independently represent an aliphatic group; and X represents a halogen atom;

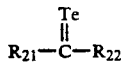

(III)

wherein $R_{21}$ represents an aliphatic group, an aromatic group, a heterocyclic group, or $—NR_{23}(R_{24})$; $R_{22}$ represents $—NR_{25}(R_{26})$, $—N(R_{27})N(R_{28})R_{29}$, or $—OR_{30}$; $R_{23}$, $R_{24}$, $R_{25}$, $R_{26}$, $R_{27}$, $R_{28}$, $R_{29}$ and $R_{30}$ each represent a hydrogen atom, an aliphatic group, an aromatic group, a heterocyclic group or an acyl group; and wherein the following substituent pairs may be bonded together to form a ring: $R_{21}$ and $R_{25}$; $R_{21}$ and $R_{27}$; $R_{21}$ and $R_{28}$; $R_{21}$ and $R_{30}$; $R_{23}$ and $R_{25}$; $R_{23}$ and $R_{27}$; $R_{23}$ and $R_{28}$; and $R_{23}$ and $R_{30}$.

6. The silver halide photographic material of any one of the claims 1-5, wherein said silver halide grains have a core and a surface layer, wherein the surface layer corresponds to 50% or less of the total grain volume, and wherein the iron compound and the tellurium compound are located in the surface layer of each silver halide grain.

7. The silver halide photographic material of claim 1, wherein the amount of the iron compound employed is $1\times10^{-6}$ to $5\times10^{-4}$ mol per mol of silver halide.

8. The silver halide photographic material of claim 1, wherein the amount of tellurium compound employed is $5\times10^{-6}$ to $5\times10^{-5}$ mol per mol of silver halide.

9. A process for manufacturing a silver halide photographic material comprising a support having thereon a silver halide emulsion containing silver halide grains of silver chloride, silver chlorobromide, silver chloroiodide, or silver chloroiodobromide each having a silver chloride content of 90 mol % or more or silver chloride, which comprises steps of preparing the silver halide emulsion while incorporating an iron compound in an amount of from $10^{-7}$ to $10^{-3}$ mol per mol of silver halide and a tellurium compound in an amount of from $10^{-7}$ to $10^{-4}$ mol per mol of silver halide into the silver halide grains before the completion of physical ripening of the grains, and then coating on the support the thus prepared silver halide emulsion.

10. The process for manufacturing a silver halide photographic material of claim 9, wherein the silver halide emulsion is mixed with a coupler dispersion, and then the mixed emulsion is coated on the support.

* * * * *